US009111735B1

(12) United States Patent
Nikolaev et al.

(10) Patent No.: US 9,111,735 B1
(45) Date of Patent: Aug. 18, 2015

(54) DETERMINATION OF ELEMENTAL COMPOSITION OF SUBSTANCES FROM ULTRAHIGH-RESOLVED ISOTOPIC FINE STRUCTURE MASS SPECTRA

(71) Applicants: Eugene N. Nikolaev, Moscow (RU); Roland Jertz, Bremen (DE); Anton S. Grigoryev, Petropavlovsk-Kamchatsky (RU); Gökhan Baykut, Bremen (DE)

(72) Inventors: Eugene N. Nikolaev, Moscow (RU); Roland Jertz, Bremen (DE); Anton S. Grigoryev, Petropavlovsk-Kamchatsky (RU); Gökhan Baykut, Bremen (DE)

(73) Assignee: Bruker Daltonik GmbH, Bremen (DE)

( * ) Notice: Subject to any disclaimer, the term of this patent is extended or adjusted under 35 U.S.C. 154(b) by 0 days.

(21) Appl. No.: 13/753,685

(22) Filed: Jan. 30, 2013

(51) Int. Cl.
*H01J 49/00* (2006.01)

(52) U.S. Cl.
CPC ..... *H01J 49/0036* (2013.01); *H01J 49/0027* (2013.01); *H01J 49/0031* (2013.01); *H01J 2237/223* (2013.01)

(58) Field of Classification Search
CPC ..... H01J 49/38
See application file for complete search history.

(56) References Cited

U.S. PATENT DOCUMENTS

| | | | | |
|---|---|---|---|---|
| 5,182,451 | A * | 1/1993 | Schwartz et al. | 250/282 |
| 8,399,827 | B1 * | 3/2013 | Grothe | 250/282 |
| 2003/0071206 | A1 * | 4/2003 | Belov et al. | 250/282 |
| 2006/0169883 | A1 * | 8/2006 | Wang et al. | 250/282 |
| 2009/0057553 | A1 * | 3/2009 | Goodenowe | 250/292 |
| 2009/0194681 | A1 * | 8/2009 | McCauley | 250/282 |
| 2012/0241603 | A1 * | 9/2012 | Scigocki | 250/282 |
| 2012/0305762 | A1 * | 12/2012 | Kaneko et al. | 250/283 |
| 2013/0183770 | A1 * | 7/2013 | Kushnir et al. | 436/501 |

OTHER PUBLICATIONS

Miura et al., "A Strategy for the Determination of the Elemental Composition by Fourier Transform Ion Cyclotron Resonance Mass Spectrometry Based on Isotopic Peak Ratios", Analytical Chemistry, vol. 82, No. 13, Jul. 1, 2010.*

Campbell et al., "Remeasurement at High Resolving Power in Fourier Transform Ion Cyclotron Resonance Mass Spectrometry", J. Am. Soc. Mass Spectrom, 1995, 6.*

Rockwood et al., "Dissociation of Individual Isotopic Peaks: Predicting Isotopic Distributions of Product Ions in MSn", J Am Soc Mass Spectrum 2003, 14, 311-322.*

(Continued)

*Primary Examiner* — Michael Logie
*Assistant Examiner* — James Choi
(74) *Attorney, Agent, or Firm* — Robic, LLP

(57) ABSTRACT

Fine structures of isotopic peak clusters of substances are determined using ultrahigh resolution mass spectrometry, e.g, FT-ICR mass spectrometry. Resolved individual peaks in the fine structure of the non-monoisotopic peak clusters of organic substances usually contain the additional elemental isotopes $^{13}C$, $^{15}N$, $^{17}O$, $^{18}O$, $^{2}H$, $^{33}S$, $^{34}S$, and combinations thereof. In each of a series of experiments, one of the non-monoisotopic peak clusters is isolated and the corresponding fine structure spectrum acquired. Abundances of the resolved fine structure peaks and their positions on the mass scale are recorded and, after measuring some or all of the isotopic peaks, the atomic composition of the measured substance is calculated. By excluding the monoisotopic peak and isolating only one isotopic peak cluster at a time, the number of ions in the FT-ICR cell is kept low, which avoids resolving power losses due to space charge effects and ion-ion interaction phenomena.

15 Claims, 18 Drawing Sheets

(56) References Cited

OTHER PUBLICATIONS

Valkenborg et al., "The isotopic distribution conundrum", 2012, fetched from http://hdl.handle.net/1942/13154.*

Shi, Stone D.-H., et al., Counting individual sulfur atoms in a protein by ultrahigh-resolution Fourier transform ion cyclotron resonance mass spectrometry: Experimental resolution of isotopic fine structure in proteins, Proc. Natl. Acad. Sci. USA, Sep. 1998, pp. 11532-11537, vol. 95.

Nikolaev, Eugene N., et al., Realistic modeling of ion cloud motion in a Fourier transform ion cyclotron resonance cell by use of a particle-in-cell approach, Rapid Commun. Mass. Spectrom., 2007, pp. 1-20, vol. 21.

Boldin, Ivan and Nikolaev, Eugene, Harmonization of electric field in FT ICR cell, The new approaches, abstract of proceedings for ASMS2010, Apr. 2010.

Boldin, Ivan and Nikolaev, Eugene, FT ICR Cell Harmonization by Shaping Excitation and Detection Electrode Assemblies, Slides from presentation at ASMS2010, May 26, 2010.

Nikolaev, Eugene, et al., The way to isotopic resolution for hundred's kDa mass ions. Experimental characterization of the new dynamically harmonized FTICR cell, abstract of proceedings for ASMS2011, Apr. 2011.

Nikolaev, Eugene, et al., The way to isotopic resolution for hundred's kDa mass ions. Experimental characterization of the new dynamically harmonized FTICR cell, Slides from presentation at ASMS2011, Jun. 8, 2011.

Nikolaev, Eugene N., et al., Initial Experimentation Characterization of a New Ultra-High Resolution FTICR Cell with Dynamic Harmonization, J. Am. Soc. Mass Spectrom., Apr. 19, 2011, pp. 1125-1133, vol. 22.

Miura, Daisuke, et al., A Strategy for the Determination of the Elemental Composition by Fourier Transform Ion Cyclotron Resonance Mass Spectrometry Based on Isotopic Peak Ratios, Anal. Chem., Jul. 1, 2010, pp. 5887-5891, vol. 82, No. 13.

Boldin, Ivan and Nikolaev, Eugene N., Fourier transform ion cyclotron resonance cell with dynamic harmonization of the electric field in the whole volume by shaping of the excitation and detection electrode assembly, Rapid. Commun. Mass Spectrom., Dec. 10, 2010, pp. 122-126, vol. 25.

Rockwood, Alan L., Deconvoluting Isotopic Distributions to Evaluate Parent/Fragment Ion Relationships, Rapid Communications in Mass Spectrometry, vol. 11, 241-248 (1997).

* cited by examiner

Table 1a

| Isotope group | Isotope | Theoretical mass value [u] | Measured mass value [u] | Mass deviation [mu] | Mass deviation [ppb] | Theoretical peak intensity [%] | Measured peak intensity [%] | Peak intensity difference [%] |
|---|---|---|---|---|---|---|---|---|
| Reserpine + H⁺ ($C_{33}H_{41}O_9N_2^+$) | | | | | | | | |
| $^{12}C$ | $^{12}C$ | 609.280657 | 609.280657 | 0.0 | 0 | 100.0 | 100.0 | 0.0 |
| $^{13}C$ | $^{15}N$ | 610.277692 | 610.277927 | 0.23 | 385 | 0.7 | 0.4 | -44.1 |
| | $^{13}C$ | 610.284012 | 610.284181 | 0.17 | 277 | 35.7 | 36.7 | 2.7 |
| | $^{2}H$ | 610.286934 | 610.286952 | 0.02 | 29 | 0.5 | 0.2 | -64.1 |
| $^{13}C_2$ | $^{13}C\,^{15}N$ | 611.281047 | 611.281264 | 0.22 | 355 | 0.3 | 0.1 | -47.3 |
| | $^{18}O$ | 611.284904 | 611.285145 | 0.24 | 394 | 1.8 | 1.4 | -25.1 |
| | $^{13}C_2$ | 611.287367 | 611.287575 | 0.21 | 340 | 6.2 | 5.5 | -10.7 |
| | $^{2}H\,^{13}C$ | 611.290289 | 611.290469 | 0.18 | 294 | 0.2 | 0.1 | -46.3 |
| $^{13}C_3$ | $^{13}C_2\,^{15}N$ | 612.284402 | 612.284543 | 0.14 | 230 | 0.05 | 0.02 | -47.8 |
| | $^{13}C\,^{18}O$ | 612.288259 | 612.288480 | 0.22 | 361 | 0.7 | 0.4 | -34.0 |
| | $^{13}C_3$ | 612.290722 | 612.290938 | 0.22 | 353 | 0.7 | 0.5 | -33.8 |
| $^{13}C_4$ | $^{13}C_2\,^{18}O$ | 613.291613 | 613.291853 | 0.24 | 391 | 0.1 | 0.1 | -33.9 |
| | $^{13}C_4$ | 613.294101 | 613.294228 | 0.13 | 207 | 0.1 | 0.02 | -64.0 |
| Substance P + 2H⁺ ($C_{63}H_{100}O_{13}N_{18}S_1^{2+}$) | | | | | | | | |
| $^{12}C$ | $^{12}C$ | 674.371350 | 674.371349 | 0.0 | 0 | 100.0 | 100.0 | 0.0 |
| $^{13}C$ | $^{33}S$ | 674.871043 | 674.870427 | -0.62 | -913 | 6.6 | 2.2 | -66.5 |
| | $^{13}C$ | 674.873030 | 674.873107 | 0.08 | 114 | 68.6 | 70.1 | 2.2 |
| $^{13}C_2$ | $^{34}S$ | 675.369251 | 675.369844 | 0.59 | 878 | 4.5 | 1.8 | -60.8 |
| | $^{13}C\,^{15}N$ | 675.371548 | 675.372137 | 0.59 | 872 | 4.5 | 1.8 | -59.1 |
| | $^{13}C_2$ | 675.374711 | 675.374959 | 0.25 | 367 | 23.2 | 16.3 | -29.7 |
| $^{13}C_3$ | $^{15}N\,^{34}S$ | 675.867767 | 675.868417 | 0.65 | 962 | 0.3 | 0.1 | -52.3 |
| | $^{13}C\,^{15}N_2$ | 675.870065 | 675.870514 | 0.45 | 664 | 0.1 | 0.1 | 1.3 |
| | $^{13}C\,^{34}S$ | 675.870932 | 675.871509 | 0.58 | 854 | 3.1 | 1.5 | -51.2 |
| | $^{15}N\,^{18}O$ | 675.872721 | 675.872078 | -0.64 | -951 | 0.2 | 0.1 | -60.7 |
| | $^{13}C_2\,^{15}N$ | 675.873227 | 675.873840 | 0.61 | 907 | 1.5 | 0.8 | -58.3 |
| | $^{13}C\,^{18}O$ | 675.875153 | 675.875848 | 0.70 | 1028 | 1.8 | 0.8 | -55.2 |
| | $^{13}C_3$ | 675.876393 | 675.876908 | 0.51 | 762 | 5.2 | 2.7 | -48.1 |
| | $^{2}H\,^{13}C_2$ | 675.877849 | 675.878466 | 0.62 | 913 | 0.3 | 0.1 | -62.4 |
| $^{13}C_4$ | $^{13}C\,^{15}N\,^{34}S$ | 676.369447 | 676.370081 | 0.63 | 937 | 0.2 | 0.1 | -41.9 |
| | $^{34}S\,^{18}O$ | 676.371476 | 676.371901 | 0.42 | 628 | 0.2 | 0.1 | -60.5 |
| | $^{13}C_2\,^{34}S$ | 676.372612 | 676.373202 | 0.59 | 872 | 1.1 | 0.4 | -63.3 |
| | $^{13}C\,^{15}N\,^{18}O$ | 676.373757 | 676.374489 | 0.73 | 1082 | 0.2 | 0.03 | -78.5 |
| | $^{13}C_3\,^{15}N$ | 676.374907 | 676.375470 | 0.56 | 832 | 0.4 | 0.1 | -73.1 |
| | $^{13}C_2\,^{33}S$ | 676.376076 | 676.376969 | 0.89 | 1320 | 0.1 | 0.1 | -6.9 |
| | $^{13}C_2\,^{18}O$ | 676.376821 | 676.377514 | 0.69 | 1026 | 0.6 | 0.2 | -64.2 |
| | $^{13}C_4$ | 676.378077 | 676.378619 | 0.54 | 801 | 0.9 | 0.3 | -70.4 |

FIGURE 6a

Table 1b

| Isotope group | Isotope | Theoretical mass value [u] | Measured mass value [u] | Mass deviation [mu] | Mass deviation [ppb] | Theoretical peak intensity [%] | Measured peak intensity [%] | Peak intensity difference [%] |
|---|---|---|---|---|---|---|---|---|
| Reserpine + $H^+$ ($C_{33}H_{41}O_9N_2^+$) | | | | | | | | |
| | $^{15}N$ | 610.277692 | 610.277745 | 0.05 | 87 | 2.1 | 1.3 | -38.1 |
| $^{13}C$ | $^{13}C$ | 610.284012 | 610.284012 | 0.00 | 0 | 100.0 | 100.0 | 0.0 |
| | $^{17}O$ | 610.284874 | 610.284961 | 0.09 | 143 | 1.0 | 0.5 | -50.0 |
| | $^{2}H$ | 610.286934 | 610.286975 | 0.04 | 67 | 1.3 | 0.7 | -46.2 |
| | $^{13}C\,^{15}N$ | 611.281047 | 611.281089 | 0.04 | 69 | 4.3 | 2.8 | -34.9 |
| | $^{18}O$ | 611.284903 | 611.284934 | 0.03 | 51 | 29.9 | 23.5 | -21.4 |
| $^{13}C_2$ | $^{13}C_2$ | 611.287367 | 611.287367 | 0.00 | 0 | 100.0 | 100.0 | 0.0 |
| | $^{13}C\,^{17}O$ | 611.288229 | 611.288280 | 0.05 | 83 | 2.0 | 1.3 | -35.0 |
| | $^{2}H\,^{13}C$ | 611.290289 | 611.290336 | 0.05 | 77 | 2.7 | 2.1 | -22.2 |
| | $^{15}N\,^{18}O$ | 612.281939 | 612.281986 | 0.05 | 77 | 2.0 | 1.6 | -20.0 |
| | $^{13}C_2\,^{15}N$ | 612.284402 | 612.284449 | 0.05 | 77 | 6.5 | 4.2 | -35.4 |
| $^{13}C_3$ | $^{13}C\,^{18}O$ | 612.288259 | 612.288259 | 0.00 | 0 | 95.6 | 100.0 | 4.6 |
| | $^{13}C_3$ | 612.290722 | 612.290722 | 0.00 | 0 | 100.0 | 98.4 | -1.6 |
| | $^{13}C_2\,^{17}O$ | 612.291584 | 612.291639 | 0.06 | 90 | 3.1 | 1.3 | -58.1 |
| | $^{2}H\,^{13}C_2$ | 612.293644 | 612.293690 | 0.05 | 75 | 4.2 | 3.4 | -19.0 |
| | $^{13}C\,^{15}N\,^{18}O$ | 613.285293 | 613.285322 | 0.03 | 47 | 4.2 | 2.4 | -42.9 |
| | $^{13}C_3\,^{15}N$ | 613.287757 | 613.287786 | 0.03 | 47 | 4.4 | 3.4 | -22.7 |
| | $^{18}O_2$ | 613.289150 | 613.289168 | 0.02 | 29 | 13.3 | 9.9 | -25.6 |
| | $^{13}C_2\,^{18}O$ | 613.291613 | 613.291596 | -0.02 | -28 | 100.0 | 100.0 | 0.0 |
| $^{13}C_4$ | $^{13}C\,^{17}O\,^{18}O$ | 613.292476 | 613.292513 | 0.04 | 60 | 1.8 | 1.0 | -44.4 |
| | $^{13}C_4$ | 613.294077 | 613.294077 | 0.00 | 0 | 49.0 | 43.5 | -11.2 |
| | $^{2}H\,^{13}C\,^{18}O$ | 613.294535 | 613.294520 | -0.01 | -24 | 2.7 | 1.1 | -59.3 |
| | $^{13}C_3\,^{17}O$ | 613.294939 | 613.294949 | 0.01 | 16 | 2.1 | 1.2 | -42.9 |
| | $^{2}H\,^{13}C_3$ | 613.296999 | 613.297029 | 0.03 | 49 | 2.8 | 1.9 | -32.1 |

FIGURE 6b

Table 1b (cont.)

| Isotope group | Isotope | Theoretical mass value [u] | Measured mass value [u] | Mass deviation [mu] | Mass deviation [ppb] | Theoretical peak intensity [%] | Measured peak intensity [%] | Peak intensity difference [%] |
|---|---|---|---|---|---|---|---|---|
| Substance P + 2H$^+$ ($C_{63}H_{100}O_{13}N_{18}S_1^{2+}$) | | | | | | | | |
| | $^{15}N$ | 674.869867 | 674.869968 | 0.10 | 150 | 9.8 | 4.5 | -54.1 |
| $^{13}C$ | $^{33}S$ | 674.871043 | 674.871114 | 0.07 | 105 | 1.2 | 0.6 | -50.0 |
| | $^{13}C$ | 674.873027 | 674.873027 | 0.00 | 0 | 100.0 | 100.0 | 0.0 |
| | $^{17}O$ | 674.873458 | 674.873469 | 0.01 | 16 | 0.7 | 0.6 | -14.3 |
| | $^{15}N_2$ | 675.368384 | 675.368466 | 0.08 | 121 | 0.9 | 0.6 | -33.3 |
| | $^{34}S$ | 675.369248 | 675.369318 | 0.07 | 104 | 19.8 | 10.9 | -44.9 |
| | $^{13}C\ ^{15}N$ | 675.371544 | 675.371613 | 0.07 | 102 | 19.8 | 12.5 | -36.9 |
| $^{13}C_2$ | $^{13}C\ ^{33}S$ | 675.372721 | 675.372841 | 0.12 | 178 | 2.4 | 1.5 | -37.5 |
| | $^{18}O$ | 675.373472 | 675.373541 | 0.07 | 102 | 11.7 | 8.7 | -25.6 |
| | $^{13}C_2$ | 675.374704 | 675.374704 | 0.00 | 0 | 100.0 | 100.0 | 0.0 |
| | $^{2}H\ ^{13}C$ | 675.376165 | 675.376218 | 0.05 | 78 | 3.4 | 1.7 | -50.0 |
| | $^{15}N\ ^{34}S$ | 675.867765 | 675.867840 | 0.08 | 111 | 5.9 | 4.7 | -20.3 |
| | $^{13}C\ ^{15}N_2$ | 675.870062 | 675.870134 | 0.07 | 107 | 2.8 | 3.1 | 10.7 |
| | $^{13}C\ ^{34}S$ | 675.870925 | 675.870952 | 0.03 | 40 | 60.7 | 50.6 | -16.6 |
| | $^{15}N\ ^{18}O$ | 675.871990 | 675.872078 | 0.09 | 130 | 3.5 | 2.1 | -40.0 |
| $^{13}C_3$ | $^{13}C_2\ ^{15}N$ | 675.873221 | 675.873269 | 0.05 | 71 | 30.3 | 23.1 | -23.8 |
| | $^{13}C_2\ ^{33}S$ | 675.874398 | 675.874504 | 0.11 | 157 | 3.6 | 2.2 | -38.9 |
| | $^{13}C\ ^{18}O$ | 675.875150 | 675.875186 | 0.04 | 53 | 36.2 | 29.3 | -19.1 |
| | $^{13}C_3$ | 675.876382 | 675.876382 | 0.00 | 0 | 100.0 | 100.0 | 0.0 |
| | $^{2}H\ ^{13}C_2$ | 675.877843 | 675.877889 | 0.05 | 68 | 5.2 | 3.2 | -38.5 |
| | $^{15}N_3\ ^{17}O$ | 676.368854 | 676.368812 | -0.04 | -62 | 1.0 | 1.4 | 40.0 |
| | $^{13}C\ ^{15}N\ ^{34}S$ | 676.369442 | 676.369468 | 0.03 | 38 | 19.6 | 16.4 | -16.3 |
| | $^{34}S\ ^{18}O$ | 676.371371 | 676.371387 | 0.02 | 24 | 11.7 | 11.3 | -3.4 |
| | $^{2}H\ ^{15}N_2\ ^{33}S$ | 676.371738 | 676.371764 | 0.03 | 38 | 4.7 | 4.4 | -6.4 |
| | $^{13}C_2\ ^{34}S$ | 676.372602 | 676.372600 | 0.00 | -3 | 100.0 | 100.0 | 0.0 |
| | $^{2}H\ ^{13}C\ ^{15}N_2$ | 676.372994 | 676.372910 | -0.08 | -124 | 2.6 | 1.9 | -26.9 |
| $^{13}C_4$ | $^{13}C\ ^{15}N\ ^{18}O$ | 676.373668 | 676.373704 | 0.04 | 53 | 11.7 | 7.8 | -33.3 |
| | $^{15}N\ ^{17}O\ ^{18}O$ | 676.374063 | 676.374114 | 0.05 | 75 | 3.4 | 2.9 | -14.7 |
| | $^{13}C_3\ ^{15}N$ | 676.374897 | 676.374911 | 0.01 | 21 | 33.7 | 24.0 | -28.8 |
| | $^{18}O_2$ | 676.375596 | 676.375630 | 0.03 | 50 | 3.2 | 2.9 | -9.4 |
| | $^{13}C_3\ ^{33}S$ | 676.376076 | 676.376093 | 0.02 | 25 | 3.9 | 3.9 | 0.0 |
| | $^{13}C_2\ ^{18}O$ | 676.376828 | 676.376833 | 0.00 | 7 | 59.7 | 51.9 | -13.1 |
| | $^{13}C_4$ | 676.378059 | 676.378059 | 0.00 | 0 | 79.7 | 73.5 | -7.8 |
| | $^{2}H\ ^{13}C_3$ | 676.379520 | 676.379544 | 0.02 | 35 | 5.7 | 6.0 | 5.3 |

FIGURE 6c

Table 2

| Peak Intensity | Probability Equivalent | Nominal mass |
|---|---|---|
| I(MP) | $[p_1(C)]^Z[p_1(A)]^X[p_1(B)]^Y$ | M |
| I($C_1$) | $Z[p_2(C)][p_1(C)]^{Z-1}[p_1(A)]^X[p_1(B)]^Y$ | M + 1 |
| I($C_2$) | $Z(Z-1)[p_2(C)]^2[p_1(C)]^{Z-2}[p_1(A)]^X[p_1(B)]^Y$ | M + 2 |
| I($A_1$) | $X[p_2(A)][p_1(C)]^Z[p_1(A)]^{X-1}[p_1(B)]^Y$ | M + 1 |
| I($A_2$) | $X(X-1)[p_2(A)]^2[p_1(C)]^Z[p_1(A)]^{X-2}[p_1(B)]^Y$ | M + 2 |
| I($C_1A_1$) | $XZ[p_2(A)][p_2(C)][p_1(C)]^{Z-1}[p_1(A)]^{X-1}[p_1(B)]^Y$ | M + 2 |
| I($B_1$) | $Y[p_2(B)][p_1(C)]^Z[p_1(A)]^X[p_1(B)]^{Y-1}$ | M + 2 |

FIGURE 7

Table 3

| *Peak 1* | *Peak 2* | *Estimated Number of Atoms* |
|---|---|---|
| MP | $C_1$ | $Z = \frac{I(C_1)}{I(MP)} \frac{p_1(C)}{p_2(C)}$ |
| $C_1$ | $A_1$ | $X = Z \frac{I(A_1)}{I(C_1)} \frac{p_2(C)}{p_1(C)} \frac{p_1(A)}{p_2(A)}$ |
| $C_2$ | $C_1A_1$ | $X = (Z-1) \frac{I(A_1C_1)}{I(C_2)} \frac{p_2(C)}{p_1(C)} \frac{p_1(A)}{p_2(A)}$ |
| $C_2$ | $A_2$ | $X = \frac{1}{2}\left(1 + \sqrt{1 + 4Z(Z-1)\frac{I(A_2)}{I(C_2)}\left(\frac{p_2(C)}{p_1(C)} \frac{p_1(A)}{p_2(A)}\right)^2}\right)$ |
| $C_2$ | $B_1$ | $Y = Z(Z-1)\frac{I(B_1)}{I(C_2)}\left(\frac{p_2(C)}{p_1(C)}\right)^2 \frac{p_1(B)}{p_2(B)}$ |

FIGURE 8

DETERMINATION OF ELEMENTAL COMPOSITION OF SUBSTANCES FROM ULTRAHIGH-RESOLVED ISOTOPIC FINE STRUCTURE MASS SPECTRA

BACKGROUND OF THE INVENTION

1. Field of the Invention

The invention relates to the determination of elemental composition of substances from ultrahigh resolution mass spectra of the fine structure of isotopic peak patterns.

2. Description of the Related Art

Contemporary instrumentation in mass spectrometry achieves new records in terms of resolving power and mass accuracy of measured substances. This generates new perspectives for analytical sciences enabling new ways for improving the established methods. With increasing resolving power it is possible to apply new methods to determine elemental composition of substances by taking a closer look at resolved isotopic peak clusters.

Mass spectrometric studies always involve the consideration of atomic isotopes in the compounds studied. In the mass spectrometry of organic compounds the atoms carbon, oxygen, nitrogen, sulfur, phosphorus, and hydrogen play the main role. Most of these elements ($^{12}C$, $^{14}N$, $^{1}H$, $^{16}O$) have one most abundant isotope with around 99% or more abundance, $^{32}S$ with around 95% abundance, while $^{31}P$ is the only stable isotope of phosphorus. The remaining isotope(s) of these elements have very minor abundances (e.g. $^{13}C$: 1.070%, $^{2}H$: 0.0115%, $^{15}N$: 0.368%, $^{18}O$: 0.205%, $^{34}S$: 4.290% and $^{33}S$: 0.75%). However, with increasing size of the molecule, i.e. with increasing number of the corresponding atoms, their isotopic peaks—even with minor abundances—start appearing in the spectrum. In the mass spectrum of an organic substance measured in a narrow m/z region covering all detectable isotopic combinations for molecular ions, the monoisotopic peak (MP) corresponds to a molecule composed of the main isotopes $^{12}C$, $^{1}H$, $^{14}N$, $^{16}O$, etc. only. Other isotopic combinations appear next to the monoisotopic peak in approximately 1 Da distances ($m_{MP}$+n with n=1, 2, 3, . . . ). The first of them at the nominal mass $m_{MP}$+1 is a cluster of peaks that correspond to molecules that contain only one of other than main isotopes of C, H, N, O and S ($^{13}C$, or only one $^{2}H$, or one $^{15}N$, or one $^{17}O$, or one $^{33}S$). The next one with the nominal mass $m_{MP}$+2 consists of a cluster of peaks corresponding to molecules having either two $^{13}C$ atoms or two $^{15}N$ atoms or one $^{13}C$ plus one $^{15}N$, or one $^{34}S$, etc. Thus, each of the isotopic peaks at the nominal masses $m_{MP}$+n consists of a unique multiple-peak system for this substance and, depending on the size of the molecule and on the heteroatoms, it can be quite complex.

Although each one of the isotopic peak clusters at the nominal masses $m_{MP}$+n consist of multiple-peak systems, in the organic mass spectrometry it became almost customary to refer to the non-monoisotopic peaks as $^{13}C$ peaks. This is mainly due to the insufficient resolving power of most of the mass spectrometers used for analytical investigations, so that each one of these isotopic clusters at the nominal masses $m_{MP}$+n appear as one unresolved peak. Therefore, with insufficient resolving powers the information hidden in the fine structure of the isotopic peak clusters cannot be used. The isotopic fine structure only becomes visible when ultrahigh resolution mass spectrometry is used.

Fourier transform ion cyclotron resonance mass spectrometry delivers the highest resolution in all mass spectrometric techniques. New developments in the ICR cells (Nikolaev, E. N.; Boldin, I. A.; Jertz, R.; Baykut, G.: Initial Experimental Characterization of a New Ultra-High Resolution FT-ICR Cell with Dynamic Harmonization; *J. Amer. Soc. Mass Spectrom.* 2011, 22, 1125-1133; and/or Boldin, I. A.; Nikolaev, E. N.: FT-ICR Cell with Dynamic Harmonization of the Electric Field in the Whole Volume by Shaping of Excitation and Detection Electrode Assembly, *Rapid Commun. Mass Spectrom.* 2011, 25, 122-126.) allow resolving powers up to tens of millions (at m/z values around 500) in moderate magnetic fields of only 7 Tesla flux density. With these ultrahigh resolving powers, fine structures of isotopic peak clusters can be easily resolved (Nikolaev, E. N.; Jertz, R.; Grigoryev, A.; Baykut, G.: Fine Structure in Isotopic Peak Distributions Measured Using a Dynamically Harmonized Fourier Transform Ion Cyclotron Resonance Cell at 7 T, *Anal. Chem.* 2012, 84, 2275-2283, incorporated herein by reference in its entirety).

One of the important tasks of mass spectrometry is to determine the elemental composition of a substance. A possible way of getting the elemental composition information is to accurately determine the molecular mass. With increasing mass accuracy the number of possible compositions to be assigned to an investigated substance decreases. Another option is to get help from fragmentation experiments (tandem mass spectrometry, MS") while evaluating possible and impossible elemental compositions and structures for the substance.

Methods to calculate elemental composition from ultrahigh resolved spectra of isotopic peak clusters do already exist. However, these conventional methods are based on data from acquiring high resolution mass spectra of a complete isotopic pattern, which includes the monoisotopic peak. As mentioned above, the instrumentation used for ultrahigh resolution mass spectra is usually an FT-ICR mass spectrometer or probably also an FT-Orbitrap™ mass spectrometer. Both the ICR-cell (an electromagnetic ion trap) and the Orbitrap™ (an electrostatic ion trap of the Kingdon type) are ion trap type mass spectrometers. In mass spectrometry with trapped ions the resolving power, as well as the mass accuracy tend to decrease if the number of the trapped ions increases. Thus, a drawback of the conventional method for obtaining the elemental composition by acquiring the complete isotopic pattern is that it operates with unnecessarily large number of ions in the measurement cell (ICR cell or Orbitrap™) Consequently, increased space charge and ion-ion interaction phenomena impair the resolving power as well as the mass accuracy. Especially in organic compounds up to molecular weights (MW) of 5,000, the monoisotopic peak is higher than the next isotope (the abundance of $^{13}C$ is about 1% of $^{12}C$). Additionally, in mass spectra of larger organic compounds, e.g., proteins like myoglobin (MW 16 kDa) or bovine serum albumin (MW 66 kDa), the isotopic distribution consists of many more peaks and approaches a Gaussian form having small monoisotopic peaks. Acquiring here the complete spectrum of the isotopic pattern also significantly increases the number of ions in the measurement cell. In other words, while the method to calculate the elemental composition desperately needs the ultrahigh resolution, the experimental part of the method partially destroys the ultrahigh resolution since the way of calculation requires full pattern information. Thus, the acquired fine structure spectra do not appear as highly resolved as they could be.

SUMMARY OF THE INVENTION

The present invention provides a method for determining the elemental composition of substances measured by ultrahigh resolution mass spectrometry based on the analysis of fine structure pattern of individually measured isotopic peak clusters. This method largely dispenses with the need to acquire complete isotopic pattern spectra (although they can be measured as complementary or starting information) and thus eliminates the disadvantages of having unnecessarily large numbers of ions in the measurement cell negatively affecting the resolving power, as well as the mass accuracy.

In a first aspect, the invention relates to a method for the determination of elemental composition of a substance using an ultrahigh resolution mass spectrum of the substance, wherein an individual non-monoisotopic peak cluster is isolated prior to an acquisition of the mass spectrum, mass values and abundances of mass peaks are analyzed in the mass spectrum, and the elemental composition of the substance is calculated using the mass values and abundances.

In various embodiments, the analysis of abundances of mass peaks may comprise determining relative abundances of the mass peaks. In further embodiments, one of an FT-ICR mass spectrometer and FT-Orbitrap™ mass spectrometer may be used as an ultrahigh resolving power mass analyzer for acquiring the ultrahigh resolution mass spectrum. In some embodiments, the isolation of an individual non-monoisotopic peak cluster is performed in the ultrahigh resolving power mass analyzer. In various embodiments, isolating an individual non-monoisotopic peak cluster comprises using a separate mass filter to selectively transmit ions of the non-monoisotopic peak cluster to an ultrahigh resolving power mass analyzer used for acquiring the ultrahigh resolution mass spectrum. In some embodiments, the mass filter is one of a linear multipole mass analyzer, 3D ion trap mass analyzer and ICR mass analyzer cell. An ICR mass analyzer cell to be used as a mass filter may be placed in the same magnet as the ICR mass analyzer cell which is used to acquire the ultrahigh resolution mass spectrum. In other embodiments, the ICR mass analyzer cell to be used as a mass filter may be placed in a separate magnet. In further embodiments, the linear multipole mass analyzer is a quadrupole rod set mass analyzer. In various embodiments, the elemental composition comprises information about the abundance of at least one of $^{13}C$, $^{15}N$, $^{17}O$, $^{18}O$, $^{2}H$, $^{33}S$, $^{34}S$.

In a second aspect, the invention relates to a method for the determination of elemental composition of a substance measured by ultrahigh resolution mass spectrometry. It comprises: acquiring a mass spectrum of the substance with a full isotopic pattern, isolating a non-monoisotopic peak cluster in the vicinity of a monoisotopic peak, acquiring a narrowband mass spectrum of the isolated non-monoisotopic peak cluster, determining relative abundances and mass values of mass peaks corresponding to individual isotopes and isotope combinations of elements in the non-monoisotopic peak cluster, isolating another non-monoisotopic peak cluster and repeating the procedures of acquiring a narrowband mass spectrum and determining relative abundances and mass values of mass peaks therein, and continuing until a predetermined minimum abundance of the non-monoisotopic peak cluster is reached, and calculating the elemental composition using the relative abundances of the individually acquired non-monoisotopic peak clusters.

In various embodiments, the predetermined minimum abundance may be defined by a signal-to-noise ratio. In particular, a detection threshold of the mass spectrum may be used as minimum abundance. In further embodiments, the substance is an organic compound, and may be one of a peptide, polypeptide, and protein. Generally, a resolving power for the acquisition of the narrowband mass spectrum may exceed that for the acquisition of the mass spectrum with full isotopic pattern by at least a factor of two. In various embodiments, calculating the elemental composition comprises cross-correlating the mass values and the relative abundances of one non-monoisotopic peak cluster to those of at least one other non-monoisotopic peak cluster. Generally, the narrowband mass spectrum may have a spectral width of less than or equal to approximately 1 Dalton, preferably less than or equal to 0.2 Dalton. Preferably, a number of ions from which the narrowband mass spectrum is acquired is lower than that from which the full isotopic pattern spectrum is acquired in order to reduce detrimental effects of at least one of space charge and ion-ion interaction on the resolving power.

Other features and advantages of embodiments of the present invention will be apparent from the accompanying drawings and from the detailed description that follows.

BRIEF DESCRIPTION OF THE DRAWINGS

FIG. 6*a* shows Table 1a, which lists mass and peak intensity values of the measured and simulated isotopic fine structure spectra of reserpine and substance P with resolving powers of 1,310,000 and 1,390,000 respectively, where the monoisotopic peak and the first four $^{13}C$ isotope clusters were isolated and measured (complete pattern spectra).

FIG. 6*b* shows the first portion of Table 1b, which lists mass and peak intensity values of the measured and simulated isotopic fine structure spectra of reserpine and substance P, where the data is obtained from individually isolated $^{13}C$ isotopic clusters (isolated isotope spectra).

FIG. 6*c* shows the second portion of Table 1b.

FIG. 7 shows Table 2, which presents different intensity peaks from the isotopic pattern of a compound $C_ZA_XB_Y$.

FIG. 8 shows Table 3, which presents different relationships for calculating a number of atoms by coefficient estimation.

DETAILED DESCRIPTION

Figure 1A:
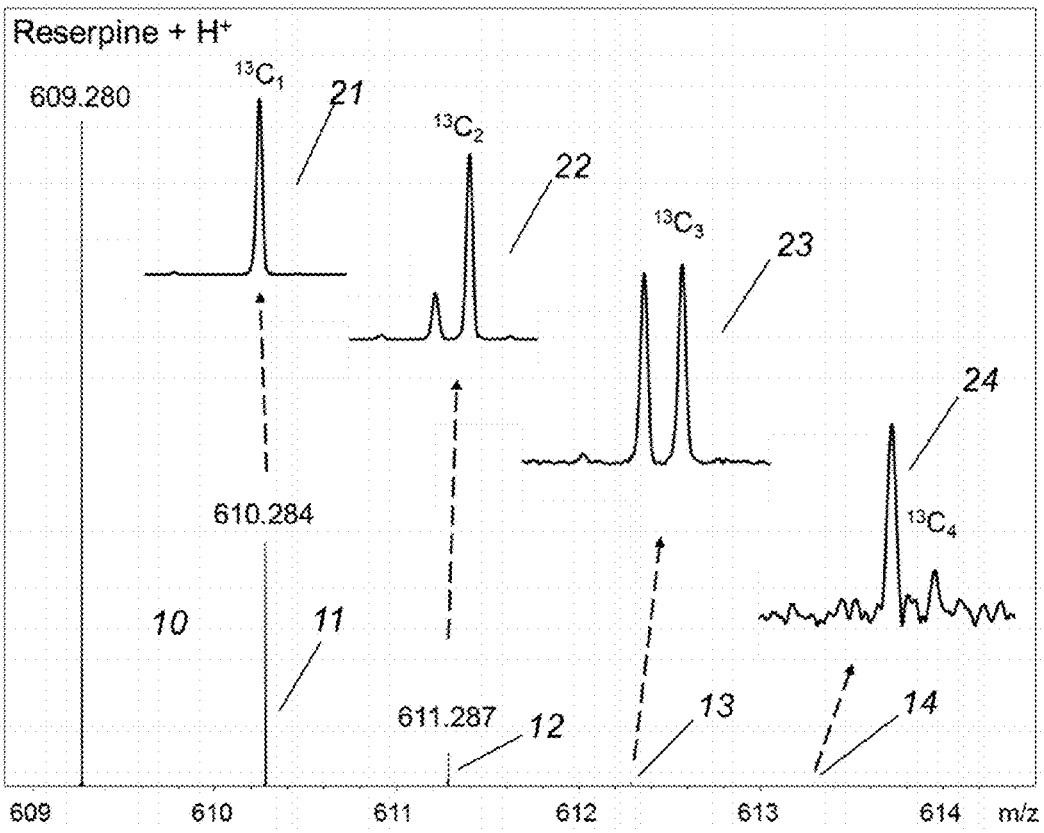
FIG. 1*a* shows the isotopic pattern of reserpine (10), and individual insets for a better view of isotopic cluster fine structures. The insets (21, 22, 23, 24) are parts of the acquired complete pattern spectrum (CPS) and display the closer view of the first, second, third, and fourth non-monoisotopic peak, respectively.
Figure 1B:
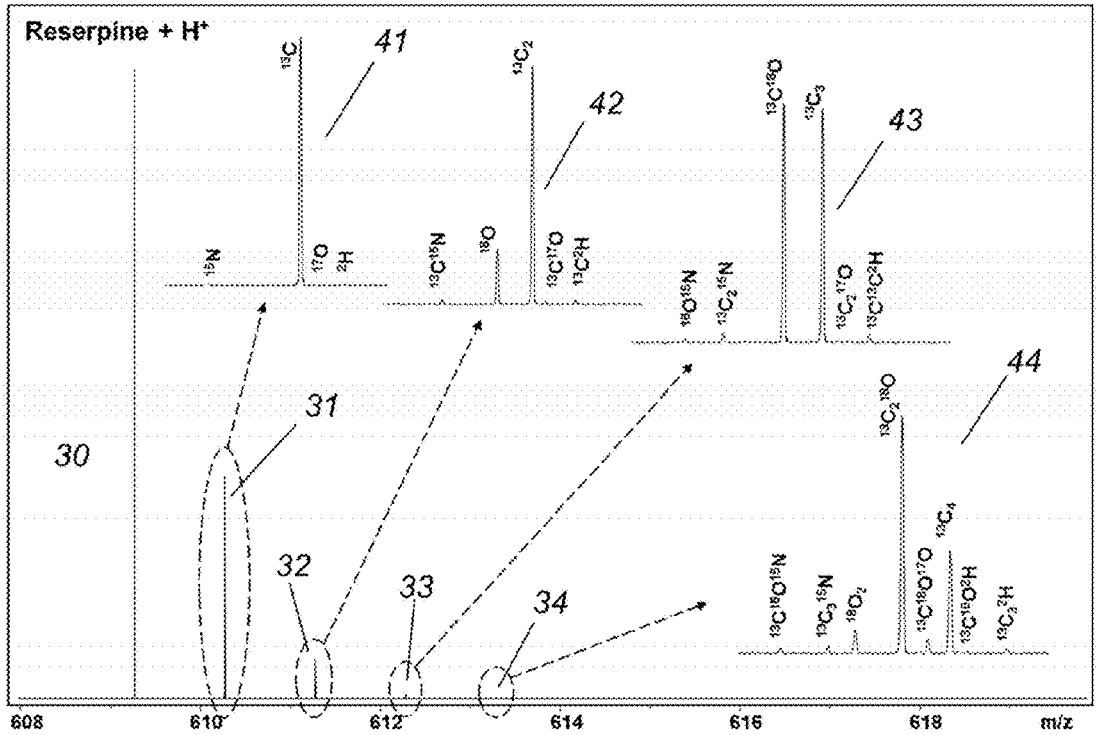
FIG. 1*b* shows again the isotopic pattern of reserpine (30). But here the insets (41, 42, 43, 44) are the separately acquired individual isotope pattern spectra of the first (31), second (32), third (33), and fourth (34) monoisotopic peak, respectively. By a comparison of FIG. 1*a* and FIG. 1*b*, the visible difference between the IIS and CPS can easily be observed. The significantly better resolving power in the IIS in FIG. 1*b* is not due to an acquisition of a narrower mass range but due to the elimination of all ions except the individual isotope peak cluster each time prior to the FT-ICR measurement.

Most contemporary FT-ICR mass spectrometers or most FT Orbitrap™ instruments contain a quadrupole mass filter. Ions pass on their way to the FT-ICR cell or to the FT-Orbitrap™ cell through this quadrupole mass filter. An isotopic peak cluster can be isolated in the quadrupole and only one selected isolated isotopic peak cluster can be allowed to enter the analyzer cell. The acquisition of an FT-ICR spectrum of this individual peak cluster generates much better resolved fine structure spectra of the isotopic peak clusters than in case of the complete isotopic pattern spectra. Hereinafter, such a mass spectrum is referred to as the individually acquired isotope cluster spectrum ("IIS" for individual isotope spectrum). The resolving power achieved in the IIS is around 4.5 million in the example of substance P, which is three times higher than the resolving power in the spectra in which the complete isotopic pattern is acquired including the monoisotopic peak. Hereinafter, the spectra with the complete isotopic pattern are referred to as the complete pattern spectrum (CPS).

The acquisition of individual isotope spectra by isolating each individual isotope pattern for the analysis in the ICR cell facilitates the identification of elemental composition but also leaves some challenges to be dealt with. Frequently, individual isotope spectra cannot be perfectly combined together to obtain one single spectrum. Therefore, the conventional calculation method cannot be used in this case. The intensity values in different acquisitions may differ and hence are not really comparable. Combining each individually acquired isotope peak (monoisotopic and non-monoisotopic ones) leads to abundance errors that could falsify the complete abundance information of the combined mass spectrum including the fine structure peaks. Therefore, if individual isotope patterns are acquired, one should not try to combine the acquired peaks of the individual patterns to a full spectrum, but rather the underlying relative intensity information. Relative intensities of fine structure peaks in each IIS have characteristic information if they are, e.g., related to the largest peak of the individual pattern. The mass and the relative abundance of each peak in the IIS can be considered and cross correlated to the other IIS for calculation of the elemental compositions.

The isolation of individual isotope clusters in order to acquire an individual isotope spectrum can not only be performed in the quadrupole mass filter, but also in the ICR cell. Before the cyclotron excitation and detection event, ions with larger and smaller masses than the peak cluster (to be isolated) can be ejected. There are two classical methods to perform this ejection. In the first method two broadband cyclotron excitation events (chirp) with high amplitude are irradiated so that all ions with smaller or larger masses than the peak cluster get strongly excited until they hit the ICR cell mantle electrodes and become neutralized. The envelope of this ejection chirp can be either defined simply by a sequence of individual frequencies or it can be calculated from the expected mass window isolated cluster in the spectrum to be acquired (SWIFT=stored waveform inverse Fourier transform).

In the traditional approach to determination of the atomic composition of molecules from accurate mass data, the result set of candidate formulae is formed by enumerating all molecular formulae and selecting those with masses equal to that of the monoisotopic peak within the limits of the mass measurement accuracy of the instrument. To narrow the search space, typically additional constraints on coefficient values are introduced. There is a risk of obtaining a seemingly unambiguous identification yet missing the true composition due to its falling outside the search space if we set the constraints too narrow. By consideration of the isotopic distribution pattern one can derive a set of rather narrow constraints for intensity ratios of peaks corresponding to different isotopic compositions.

As the natural distribution of isotopes for all elements in the compound is known, one can determine coefficient values for these elements in the compound formula. Since the mass spectrum approximates the isotopic distribution by intensities of peak with particular m/z, instead of probabilities we can use intensities of the corresponding isotopic compositions. It is necessary to consider, though, the potential errors in measurements of intensities caused by nonlinearity of signal dependence on the number of ions in FT-ICR mass spectrometry. For this reason one may not be able to calculate the exact composition, but rather estimate the range of coefficient values, and this is in many cases sufficient for unambiguously writing the composition formula.

As mentioned above, previously used methods (Shi, S. D.-H.; Hendrickson, C. L.; Marshall, A. G.: Counting Individual Sulfur Atoms in a Protein by Ultrahigh resolution Fourier Transform Ion Cyclotron Resonance Mass Spectrometry: Experimental Resolution of Isotopic Fine Structure in Proteins; *Proc. Natl. Acad. Sci. USA,* 1998, 95 11532-11537; Miura, D.; Tsuji, Y.; Takahashi, K.; Wariishi, H.; Saito, K.: A Strategy for the Determination of the Elemental Composition by Fourier Transform Ion Cyclotron Resonance Mass Spectrometry Based on Isotopic Peak Ratio; *Anal. Chem.* 2010, 82, 5887-5891) operate on the whole mass spectrum of the isotope cluster pattern, which is the CPS, whereas the resolving power, mass accuracy and the dynamic range are better in a (very) narrow band spectrum, in the isolated isotope spectra.

The two options are either to assemble a single mass list (from a single mass spectrum) from isolated isotope spectra, or to find/develop a method that can operate with/on separately acquired isolated isotope spectra. The second option is more advantageous, because, as mentioned above, intensity ratios are not accurate if peaks belong to different isolated isotope spectra. Also in the latter one, only a few isolated isotope spectra need to be measured, for example one or two, and this decreases the measurement time.

From isolated isotope spectra of one compound a single mass list (one single mass spectrum) can be assembled, but as mentioned above, intensity ratios are not accurate if peaks belong to different isolated isotope spectra. A method that can operate with the isolated isotope spectra is more advantageous. Also only a few isolated isotope spectra need to be measured, which decreases the measurement time.

A set of equations can be derived that allows estimating coefficients in compound's composition from intensity ratios without assembling the complete pattern spectrum. Suppose we have a compound consisting of C, H, O, N, S and P atoms. In the fine structure, any observable isotopic substitution for these elements results in either a shift from the monoisotopic peak to higher masses nominally by one mass unit (e.g. $^{1}H$ to $^{2}H$, $^{32}S$ to $^{33}S$), or nominally by two mass units (e.g. $^{16}O$ to $^{18}O$ or $^{32}S$ to $^{34}S$). It is assumed that A and B are fictitious elements with isotopes $^{M(A)}A$, $^{M(A)+1}A$, $^{M(B)}B$, $^{M(B)+2}B$ and a third element C, which can be considered as carbon.

Expanding the multinomial distribution that describes the isotopic pattern of a compound $A_XB_YC_Z$ consisting of elements A, B, and C, we obtain expressions for intensities of the first several peaks given in Table 2 (shown in FIG. 7). Here A and B denote elements with isotopes shifted by 1 and 2 u correspondingly, and C is the carbon. Equations that allow estimating the coefficients X, Y, Z corresponding to elements A, B and C are given in Table 3 (shown in FIG. 8). They are derived by dividing the expressions for peak intensity term by term and subsequently solving the equations for X, Y and Z. The coefficient Z for carbon is estimated from the complete pattern spectrum which does not need the fine structure resolution and thus is readily observable in experiments.

Figure 2A:
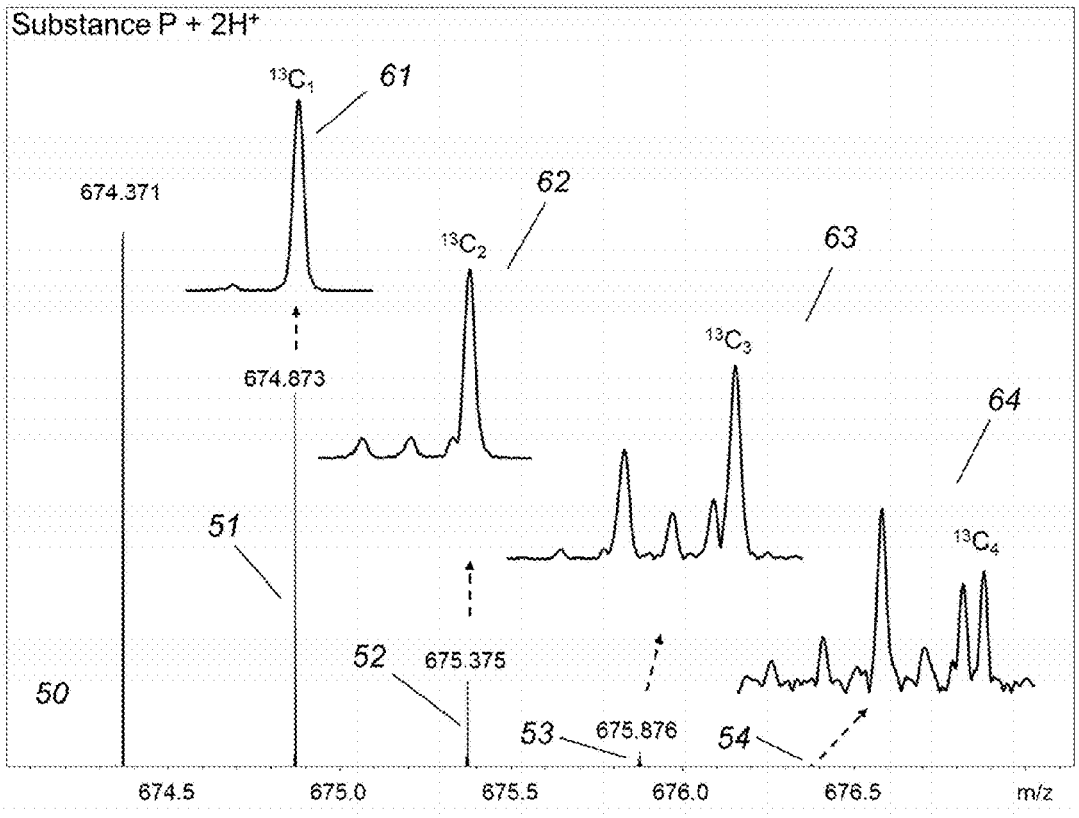
FIG. 2*a* shows the isotopic pattern of substance P (50), and individual insets for a better view of isotopic cluster fine structures. The insets (61, 62, 63, 64) are parts of the acquired complete pattern spectrum and display the closer view of the first (51), second (52), third (53), and fourth (54) non-monoisotopic peak, respectively.
Figure 2B:
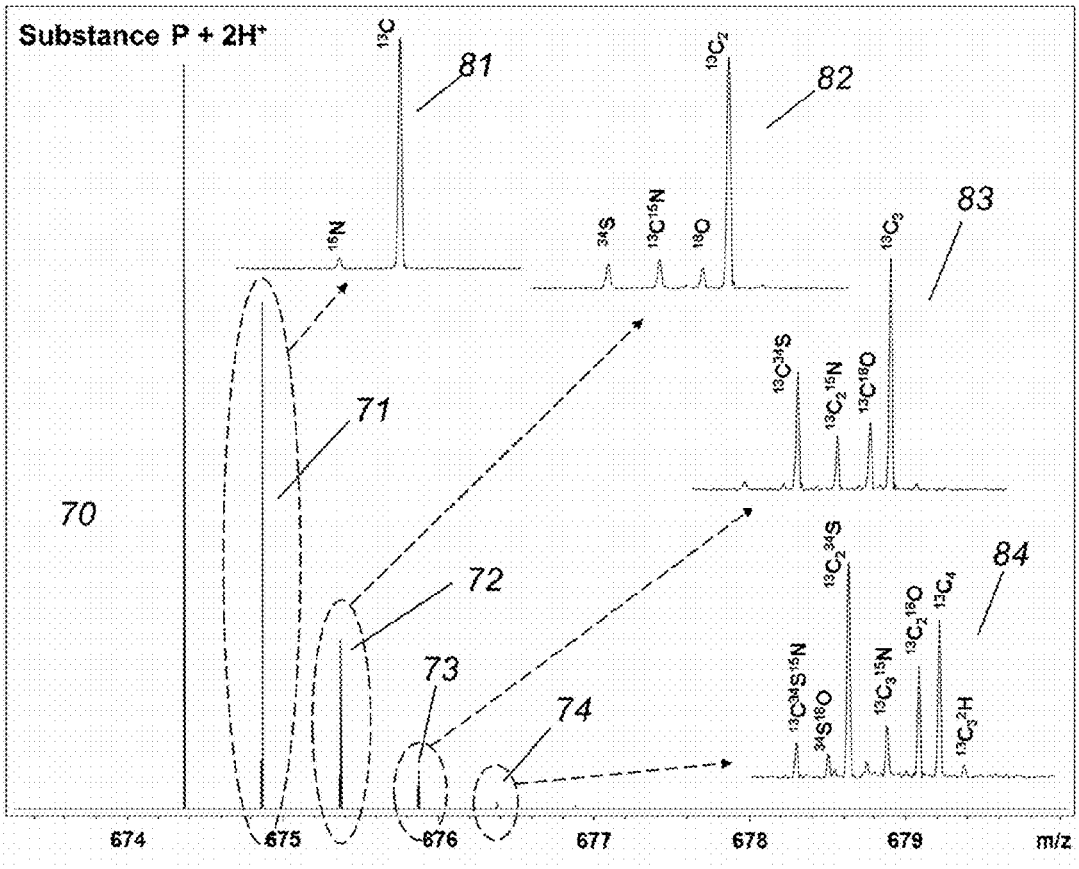
FIG. 2*b* shows again the isotopic pattern of substance P (70). But here, the insets (81, 82, 83, 84) are the separately acquired individual isotope pattern spectra of the first (71), second (72), third (73), and fourth (74) monoisotopic peak, respectively. By a comparison of FIG. 2*a* and FIG. 2*b*, the visible difference between the IIS and CPS can again easily be observed. The significantly better resolving power of the IIS in FIG. 2*b* is due to the elimination of all ions except the individual isotope cluster prior to each FT-ICR measurement.
Figure 3A:
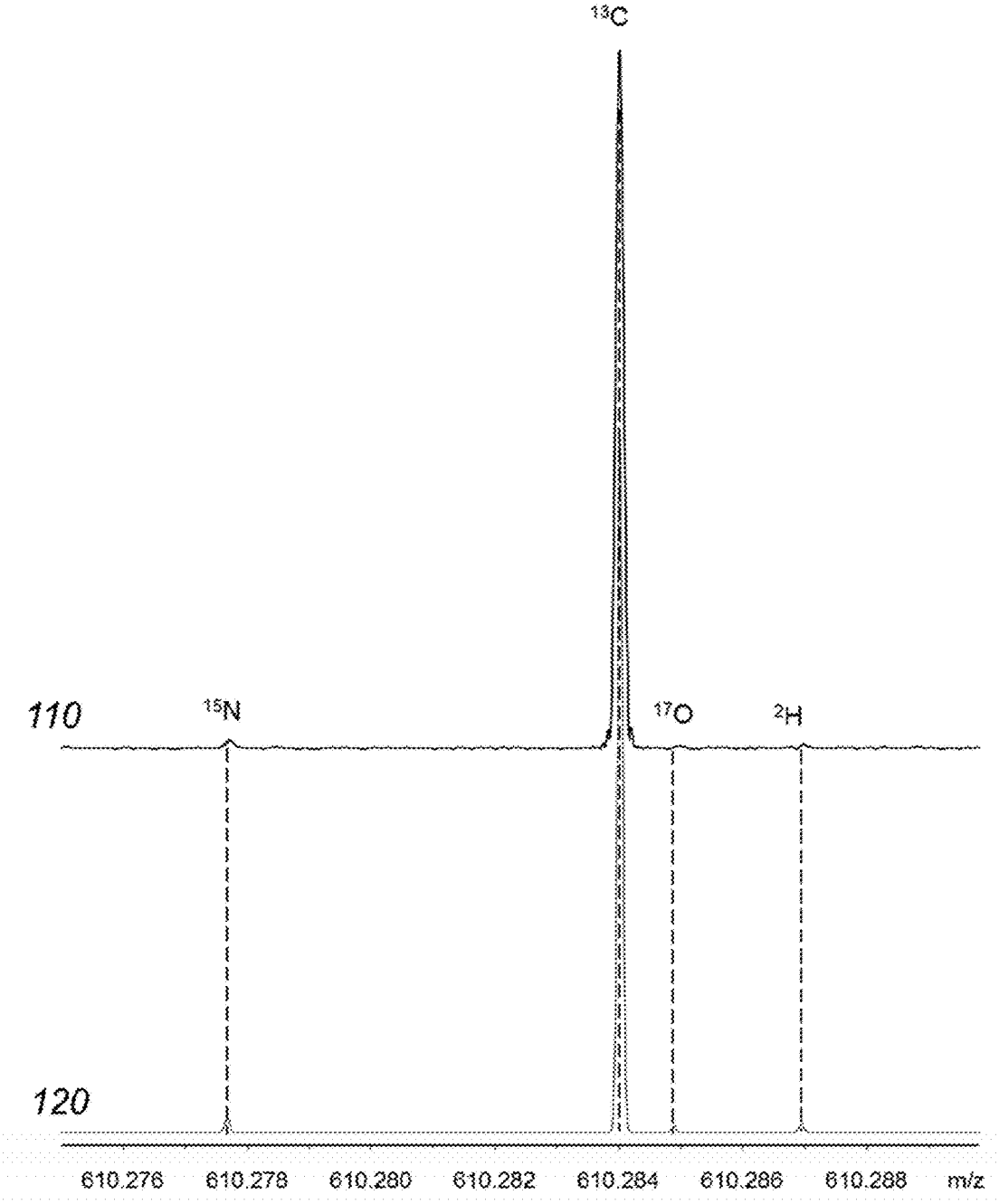
FIG. 3*a* shows the individual fine structure spectrum of the first non-monoisotopic peak cluster of reserpine. The spectrum at the top is the acquired spectrum (110) and the lower one is the simulated spectrum (120) showing the elemental compositions of the individual peaks. In this spectrum the peak of the ion containing one $^{13}C$ atom is more than an order of magnitude larger than the ones of ions containing isotopes of oxygen and nitrogen.
Figure 3B:
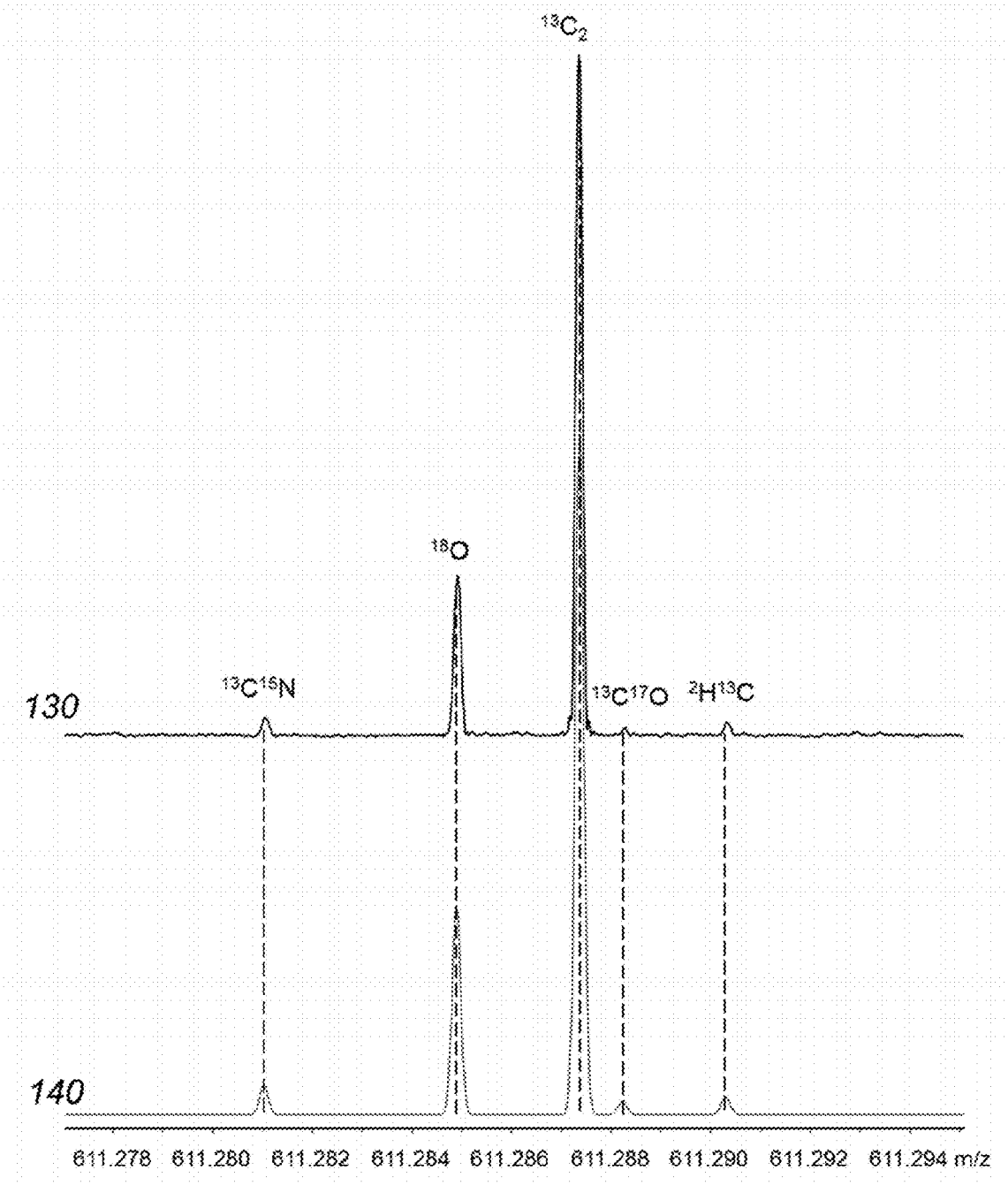
FIG. 3*b* shows the individual fine structure spectrum of the second non-monoisotopic peak cluster of reserpine. The spectrum at the top is the acquired spectrum (130) and the lower one is the simulated spectrum (140) showing the elemental compositions of the individual peaks. In this spectrum the peak of the ion containing two $^{13}C$ atoms is again the largest peak, but in particular the abundance of the peak corresponding to a $^{18}O$ containing ion is significantly increased here.
Figure 3C:
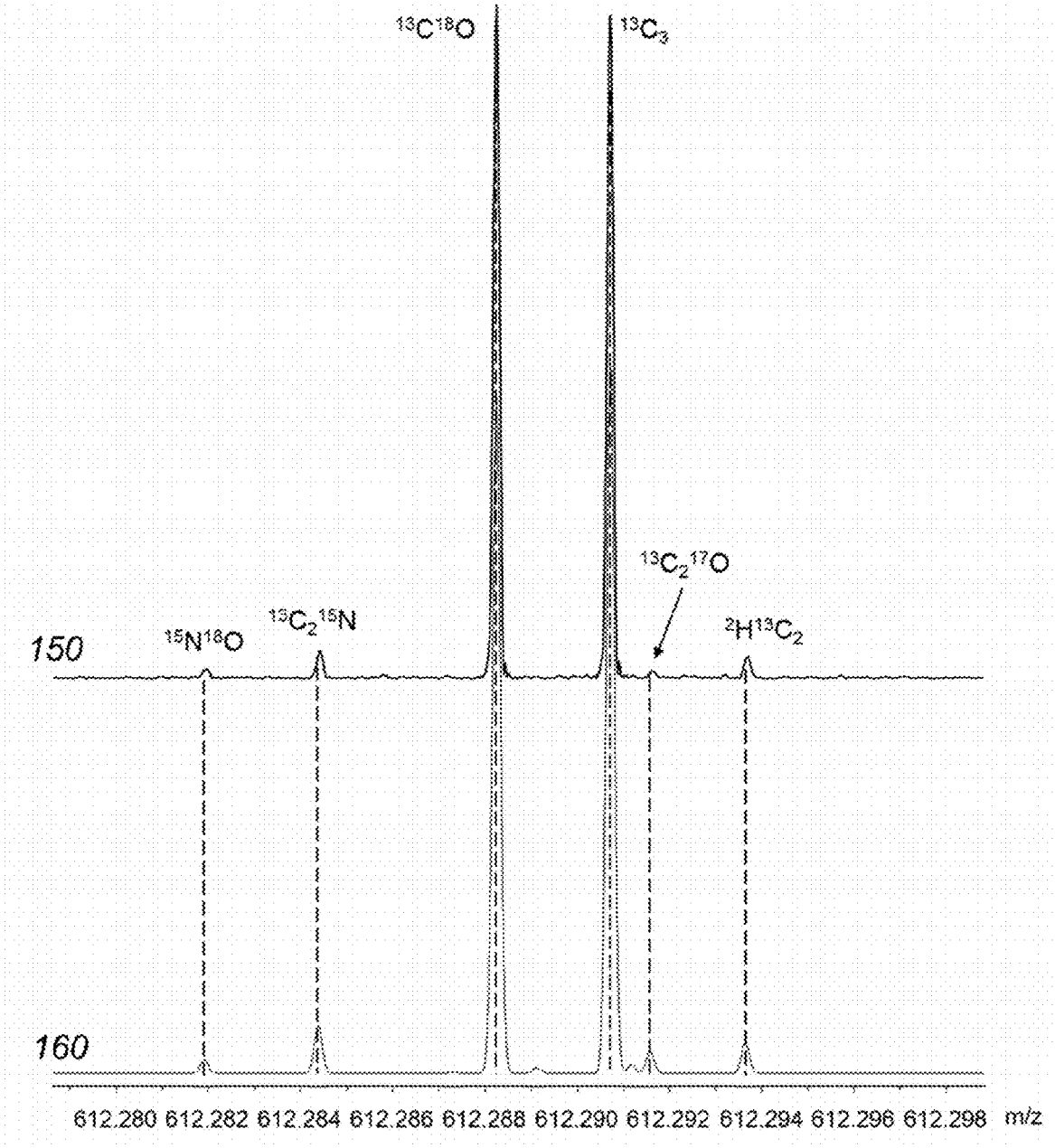
FIG. 3*c* shows the individual fine structure spectrum of the third non-monoisotopic peak cluster of reserpine. The spectrum at the top is the acquired spectrum (150) and the lower one is the simulated spectrum (160) showing the elemental compositions of the individual peaks. The peak of the ion containing a $^{13}C$ and one $^{18}O$ atom is about the same abundance as the one with three $^{13}C$ atoms.
Figure 3D:
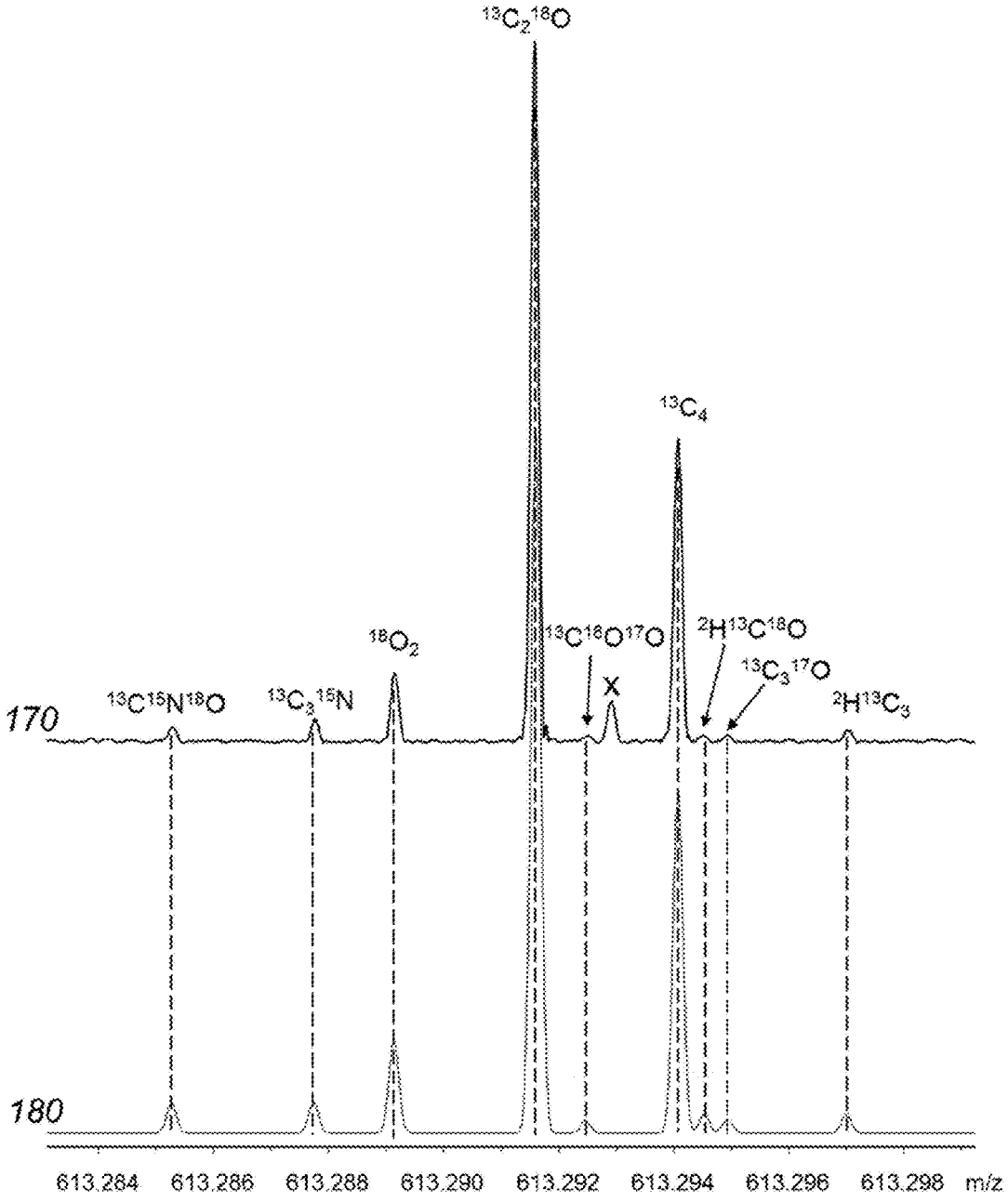
FIG. 3*d* shows the individual fine structure spectrum of the fourth non-monoisotopic peak cluster of reserpine. The spectrum at the top is the acquired spectrum (170) and the lower one is the simulated spectrum (180) showing the elemental compositions of the individual peaks. In this non-monoisotopic peak cluster the ion with the most abundant peak is not the one with four $^{13}C$ atoms but the one with two $^{13}C$ and one $^{18}O$. The peak marked with X is a false peak in the spectrum, most likely due to electronic noise, and does not correspond to an ion.
Figure 4A:
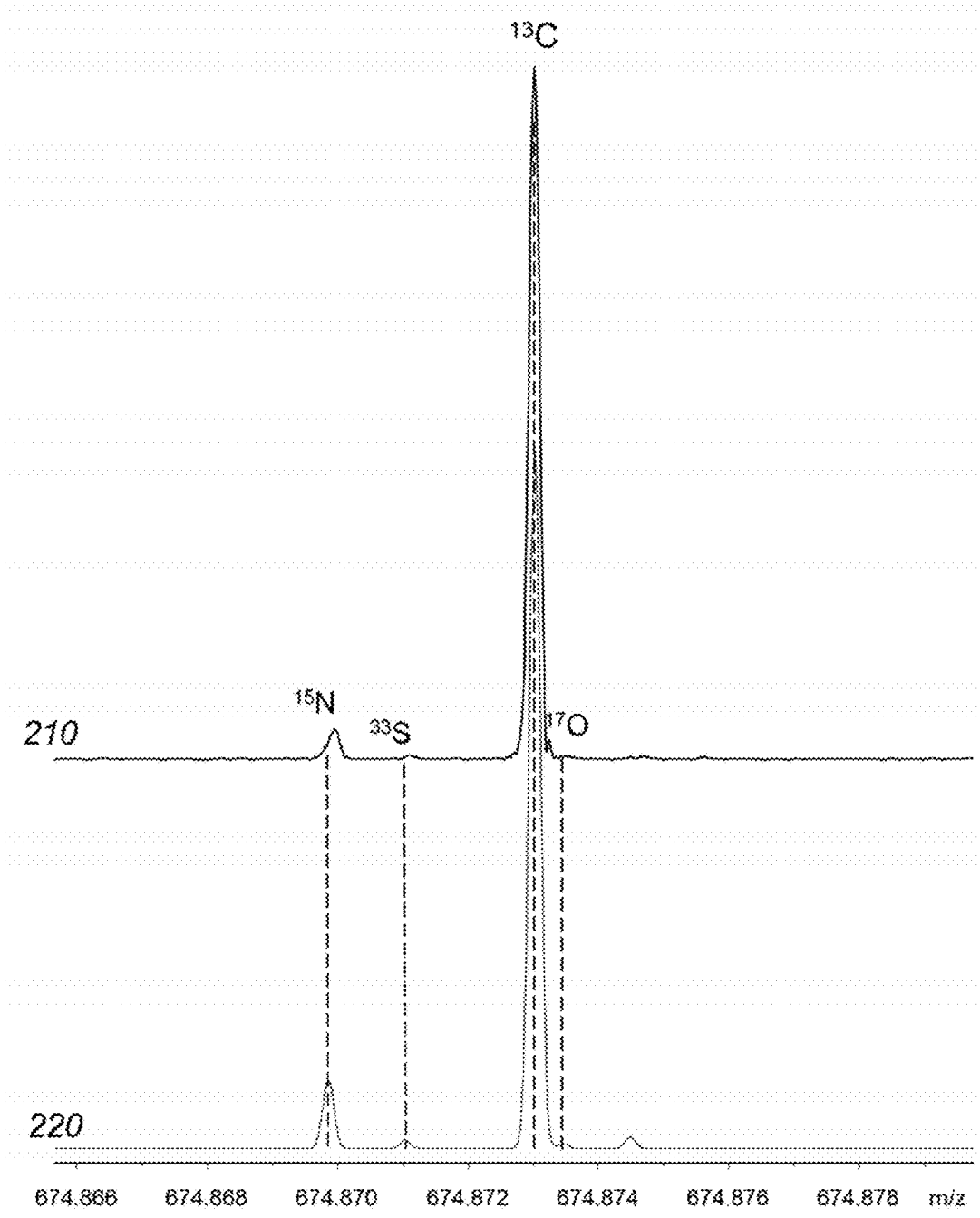
FIG. 4*a* shows the individual fine structure spectrum of the first non-monoisotopic peak cluster of substance P. The spectrum at the top is the acquired spectrum (210) and the lower one is the simulated spectrum (220) showing the elemental compositions of the individual peaks. In this spectrum the peak of the ion containing one $^{13}C$ atom is about an order of magnitude larger than the ones of ions containing isotopes of oxygen and nitrogen.
Figure 4B:
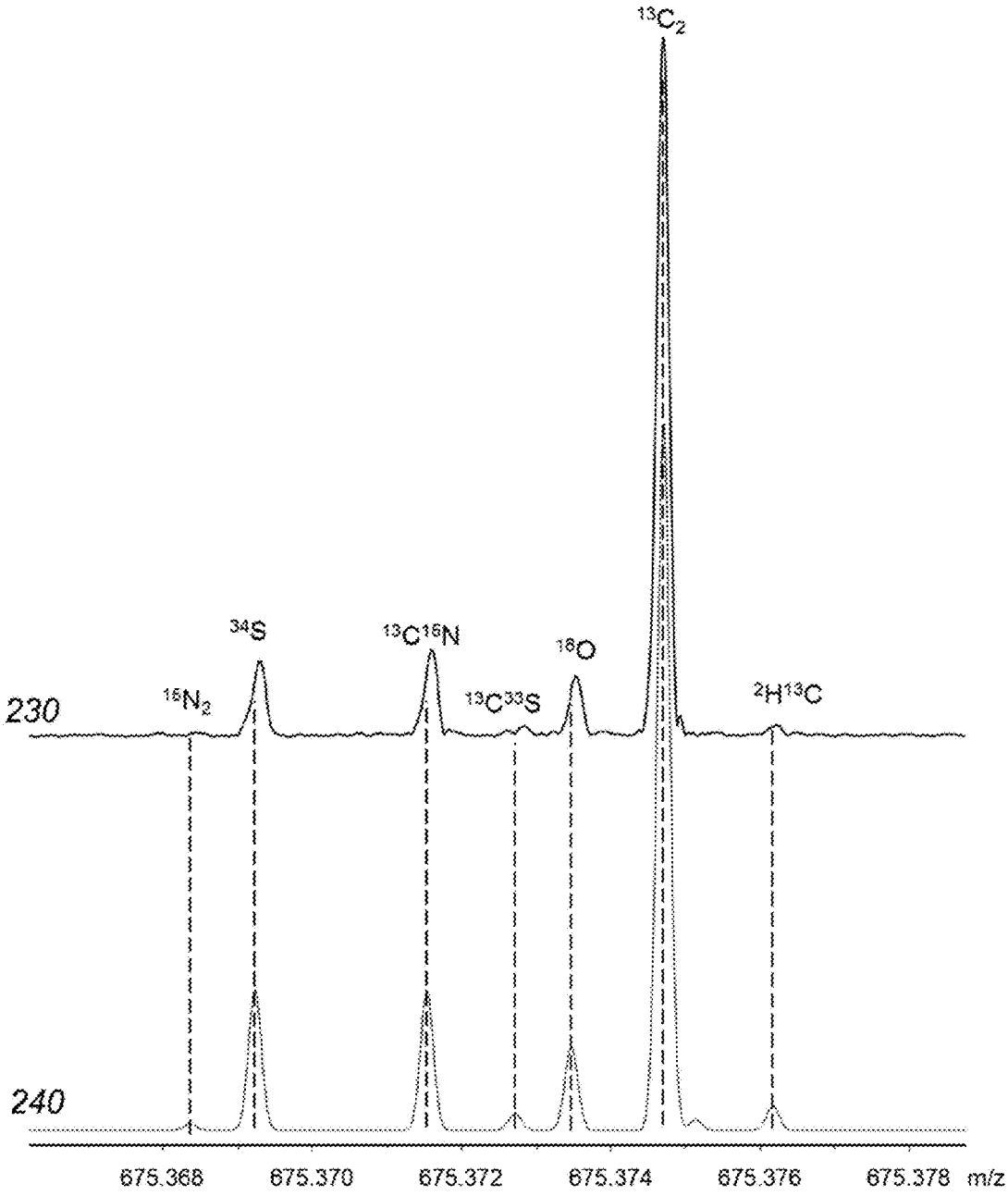
FIG. 4*b* shows the individual fine structure spectrum of the second non-monoisotopic peak cluster of substance P. The spectrum at the top is the acquired spectrum (230) and the lower one is the simulated spectrum (240) showing the elemental compositions of the individual peaks. In this spectrum the peak of the ion containing two $^{13}C$ atoms is the largest peak, but the abundances of the other peaks are somewhat higher here compared to the first non-monoisotopic peak cluster.
Figure 4C:
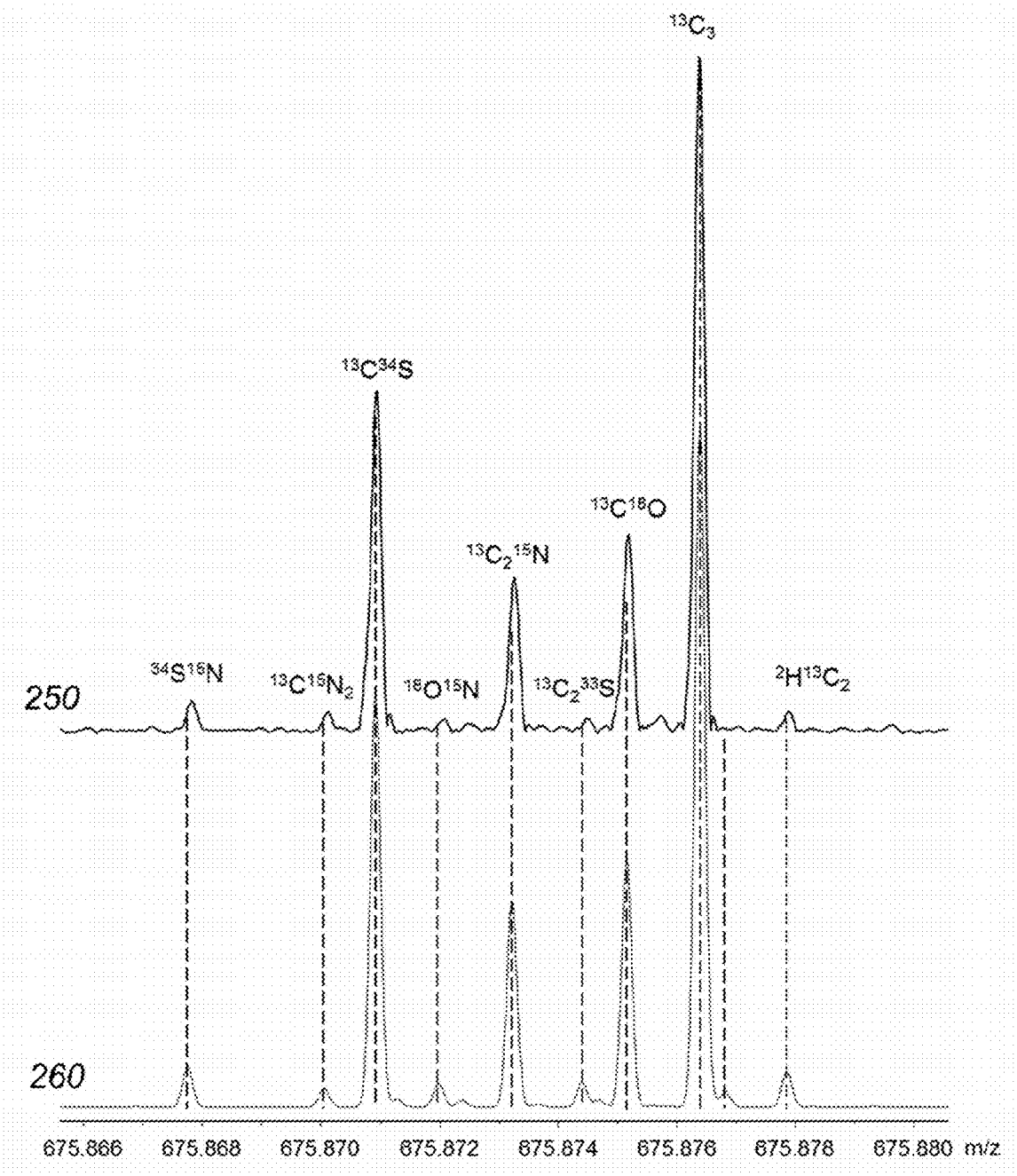
FIG. 4*c* shows the individual fine structure spectrum of the third non-monoisotopic peak cluster of substance P. The spectrum at the top is the acquired spectrum (250) and the lower one is the simulated spectrum (260) showing the elemental composition of the individual peaks. Individual peaks slowly come to comparable intensities here, but the peak of the ion containing three $^{13}C$ atoms is the largest one.
Figure 4D:
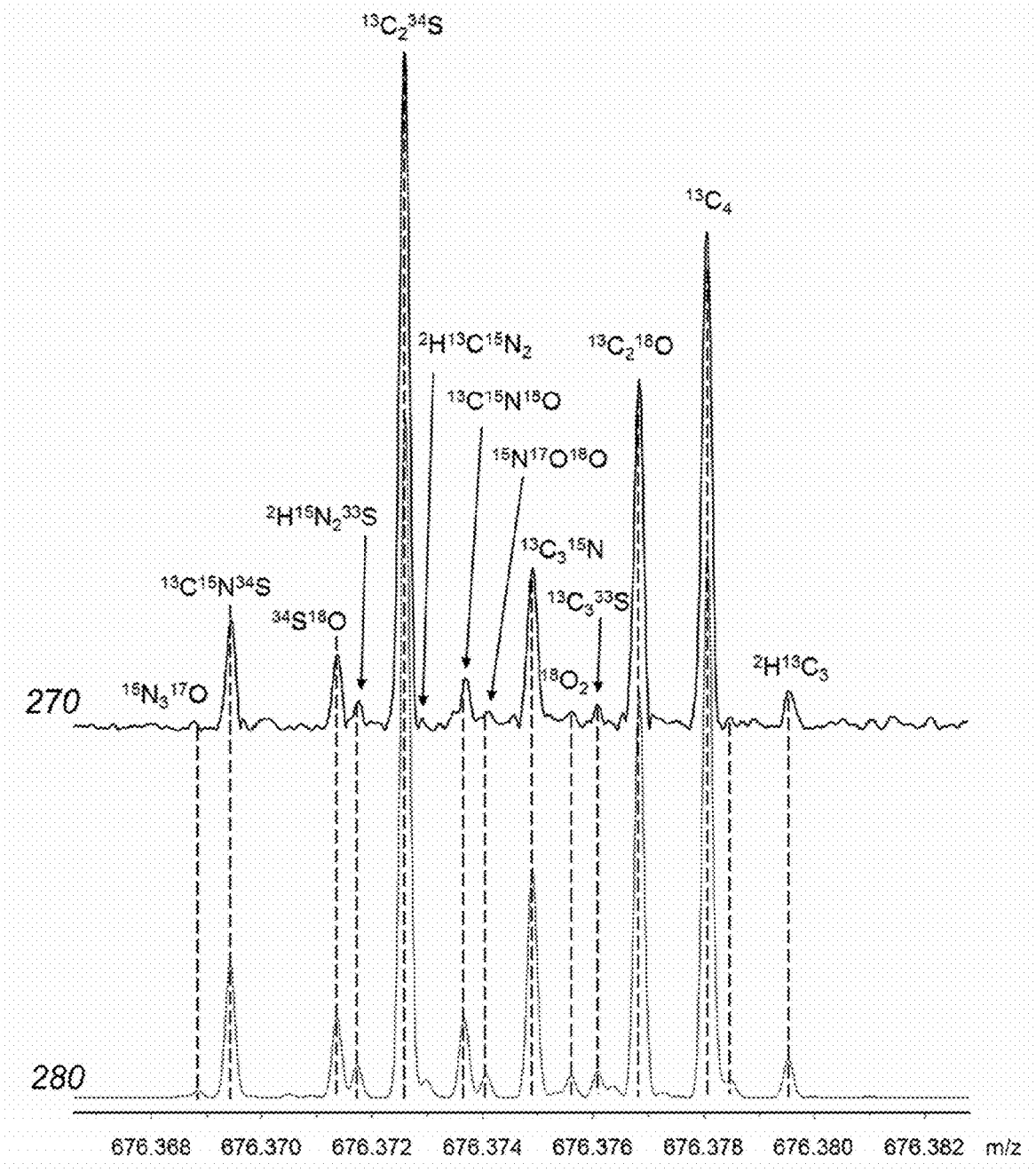
FIG. 4*d* shows the individual fine structure spectrum of the fourth non-monoisotopic peak cluster of substance P. The spectrum at the top is the acquired spectrum (270) and the lower one is the simulated spectrum (280) showing the elemental compositions of the individual peaks. This non-monoisotopic peak cluster contains several peaks of comparable abundances. The most abundant peak here is not the one with four $^{13}C$ atoms but the one with two $^{13}C$ and one $^{34}S$. After single-point calibrating each fine structure spectrum in reference to the $^{13}C_n$ peak the maximum mass deviation of all clearly identified isotopes is 160 ppb. The average value of the absolute deviations is 69 ppb which corresponds to 45 μu (micro atomic mass units).

The complete pattern spectra, by way of example, of protonated reserpine and doubly protonated substance P (resolving power ~1.3 million) displayed in FIGS. 2*a* and 2*b*, respectively, and the isolated isotope spectra of these substances (resolving power ~4 million) displayed in FIGS. 3*a*-3*d* and 4*a*-4*d*, respectively, clearly show significant difference not only in resolving powers but also in intensity ratios of particular peaks. The reason for this is not the narrowed mass range of the isolation procedure but rather the total number of ions used in the measuring procedure. The complete pattern spectra include all isotopic peaks, with the monoisotopic peak being the most abundant peak in mass in the spectra. For this reason, in the case of the complete pattern spectra, ion-ion interaction effects, as well as the general space charge effects, can be much stronger than in the isolated isotope spectra.

The single point calibration in the complete pattern spectra is made for the monoisotopic peak. The peaks in the $^{13}C$ clusters shift in the direction to higher masses (compared to the simulated position on m/z scale). This is to be expected at least due to the space charge effects which reduce the measured cyclotron frequency.

Table 1a (depicted in FIG. 6*a*) shows peak positions and peak intensities in the complete pattern fine structure spectra. Table 1b (depicted in FIGS. 6*b* and 6*c*) shows the isolated isotope pattern spectra. The pure $^{13}C$ peak is calibrated on the mass scale in each fine structure spectrum and the distances of this peak to the other peaks are compared.

As is known from a realistic modeling of the ion cloud motion using the particle-in-cell approach (Nikolaev, E. N.; Heeren, R. M. A.; Popov, A. M.; Pozdneev, A. V.; Chingin, K. S.: Realistic modeling of ion cloud motion in a Fourier transform ion cyclotron resonance cell by use of a particle-in-cell approach. *Rapid Commun. Mass Spectrom.* 2007, 21, 3527-3546.), during the detection period small ion clouds in an ICR cell strongly interact with the large clouds of ions of very close m/z because they are coming through each other with frequency equal to the difference of their cyclotron frequencies. This interaction can lead to a peak coalescence phenomenon, it can also lead to a complete or partial destruction of the small ion cloud, which either reduces the peak intensity or totally annihilates the small peak. Very accurate tuning of the total number of ions in the cell is needed to prevent small peak elimination. Therefore, in an isotopic fine structure spectrum, due to the ion cloud interactions, the intensities of smaller peaks are generally suppressed by the nearest abundant peak which is in the first numbers of isotopic groups mostly the "pure" $^{13}C_n$. In the Table 1b, the peak intensity deviation column is calculated in reference to the largest peak in each fine structure spectrum (the pure $^{13}C$ peak in all, but the last isotopic cluster). Therefore, it heavily contains a general suppression effect. It seems to be more reasonable to compare intensities of small peaks in the spectra with the corresponding small peaks in the simulated isotopic distribution spectrum, and to suggest that the effect of the peak suppression by the largest peak in the fine structure spectrum has a similar magnitude.

Larger order isotopic peak clusters (larger number of $^{13}C$ atoms) consist of more than one abundant peak. With increasing number of abundant peaks in an individual isotope spectrum, the peak abundances in an isotopic cluster get closer to each other, and the suppression effect becomes less significant in terms of relative intensities. As an example, two equally abundant peaks experience equal suppression effects by each other and, although their absolute intensities may suffer, their relative intensities will practically be not affected.

The isotopic fine structure allows estimation of the elemental composition to facilitate compound identification using the accurate mass-based approach. The intensity deviations caused by nonlinearity in signal dependence on the number of ions in FT-ICR mass spectrometry is clearly the limiting factor of the composition estimation procedure. For example, one might identify a peak with m/z=674.37135 (substance P+$^{2}$H+) with m/z tolerance of 0.2 ppm. Without sophisticated chemical feasibility filters this would result in sixty-five candidate formulae. With 70%-accurate coefficient estimates, one could cut the number of candidate formulae to about one-third, with 20% accuracy one would get only five candidates to disambiguate, and with 10% tolerance the composition would become unique.

EXAMPLE

Figure 5:
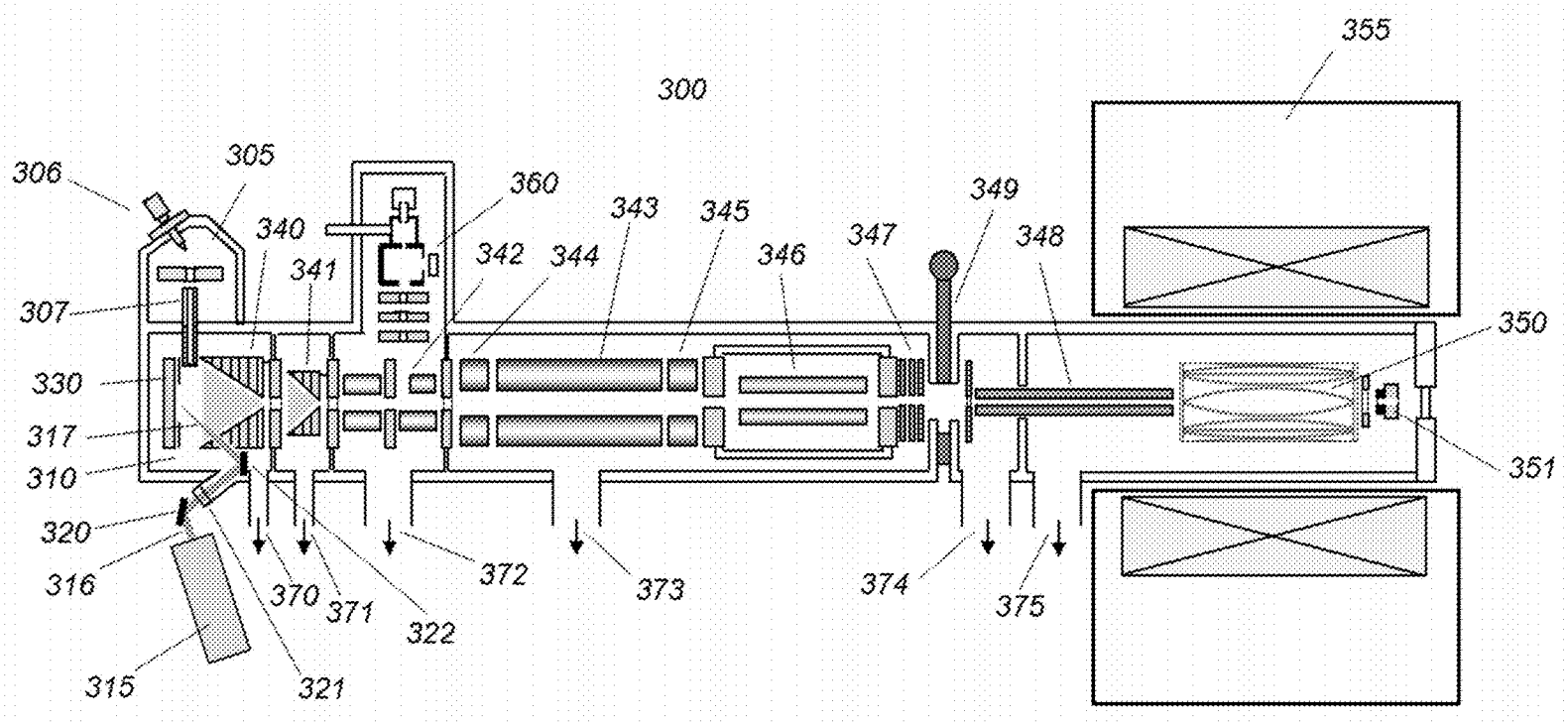
FIG. 5 shows a schematic view of an FT-ICR mass spectrometer arrangement (not to scale) suitable for carrying out an embodiment of a method according to the invention.

Typical example experiments include using the FT-ICR mass spectrometer which is described in detail in Nikolaev, E. N.; Boldin, I. A.; Jertz, R.; Baykut, G.: Initial experimental characterization of a new ultra-high resolution FTICR cell with dynamic harmonization, *J. Am. Soc. Mass Spectrom.* 2011, 22, 1125-1133, the content of which is incorporated herein by reference in its entirety. The basic arrangement is shown in FIG. 5. The mass spectrometer is equipped with an electrospray ion source, a quadrupole mass selector, a hexapole collision cell, and a hexapole ion guide for transferring ions to the ICR cell, which is placed in the center of an actively shielded 7 T superconducting magnet (Bruker Biospin, Wissembourg, France).

FIG. 5 shows a simplified schematic view of a contemporary FT-ICR mass spectrometer (300). Ions can be formed in an electrospray ion source (305) with a sprayer (306) and an electrospray capillary (307). Ions can also be formed in a matrix assisted laser desorption (MALDI) source (310). A laser (315) generates a laser beam (316) which is reflected on a mirror (320), goes through a laser window (321) and is reflected on a focusing mirror (322), becomes a focused converging beam (317), hits the MALDI target (330), and produces ions. Ions generated either by electrospray or MALDI fly into the first ion funnel (340). After the first ion funnel, ions pass the second ion funnel (341) and enter an octopole ion guide (342). This octopole is divided into two parts, and the second part of it is constructed to accept negative ions generated in the chemical ionization chamber (360) if an electron transfer dissociation process is desired. After the divided octopole ion guide ions pass the quadrupole mass filter (343) with its pre-filter (344) and post-filter (345). Subsequently, on their way to the mass analyzer, ions enter the collision cell (346) which is a hexapole ion guide in a closed chamber inside the vacuum system, operated at an elevated pressure. The collision chamber is used to achieve collision induced dissociation of selected ions if desired. After the collision chamber, ions are focused by the Einzel lens system (347) into the hexapole ion transfer optics (348) in the ultra-high vacuum (UHV) tube and transferred into the FT-ICR cell (350). In order to be able to separate the UHV part from the rest of the vacuum system a gate valve (349) can be used. The ICR cell in this figure is a dynamically harmonized ICR cell (350) which is used for ultrahigh resolution measurements. It is positioned in the UHV tube at the magnetic field center of a shielded superconducting magnet (355). An electron emitter (351) may provide electrons for electron capture dissociation in the ICR cell. The pumping access (370) of the first vacuum stage containing the first ion funnel is connected to a mechanical rotary vacuum pump. The pumping access (371) of the second vacuum stage containing the second ion funnel is connected to the interstage of the first turbomolecular pump, which also pumps the third vacuum stage containing the divided octopole through the access (372). The other pumping accesses (373), (374), and (375) of the following vacuum stages are connected to turbomolecular pumps.

This type of ICR cell is also described in the aforementioned article. The specific design and electrode geometry are chosen based on digital simulations (Nikolaev, E. N.; Boldin, I. A.; Jertz, R.; Fuchser, J.; Baykut, G.: *Proceedings of the 59th ASMS Conference on Mass Spectrometry and Allied Topics*, Denver, Colo., Jun. 5-9, 2011; Boldin, I. A.; Nikolaev, E. N.: *Proceedings of the 58th ASMS Conference on Mass Spectrometry and Allied Topics*, Salt Lake City, Utah, May 23-27, 2010) using an ion motion simulation program (Boldin, I. A.; Nikolaev, E. N.: *Rapid Commun. Mass Spectrom.* 2011, 25, 122-126). The length L of the cell is 150 mm, and the inner diameter is 56 mm. The end-cap electrodes have orifices of 6 mm diameter in their centers. An additional electrode at the entrance of the cell is added here to provide focusing of incoming ions. On both end-cap electrodes as well as the entrance lens, a typical DC voltage of 1.5 V is directly applied during the detection sequence, and the same DC voltage is applied to the convex electrodes of the cylindrical surface, while the concave electrodes remain grounded. During the injection of ions, the entrance lens and the front end-cap electrode are pulsed down to typically −10 V.

Two different samples are used for the example measurements, reserpine (no. R-0875 by Sigma Aldrich, Munich, Germany) and substance P (no. S-6883 by Sigma Aldrich, Munich, Germany). Both samples are sprayed by direct infusion at a concentration of 1 pmol/μL in water/methanol (1:1 in vol) into which 0.1% formic acid is added, with a flow rate of 120 μL/h. Nitrogen is used as the drying gas, heated up to 200° C. The sample concentration is chosen very high in order to be able to select all desired $^{13}C$ isotope cluster groups at proper intensities using the same sample preparation; the intensity ratio of the highest mass peak in the fourth $^{13}C$ isotope cluster peak of reserpine to the monoisotopic $^{12}C$ mass peak is about 0.12%.

Reserpine ions are generated only as singly protonated (m/z 609) molecules, substance P ions as singly (m/z 1347), doubly (m/z 674), and triply (m/z 452) protonated molecules. In the case of substance P, only the doubly protonated molecular ions are used in the example experiments.

In the first step, a mass spectrum of the pseudomolecular ion containing the monoisotopic peak and several isotopic peak clusters is acquired. Therefore, the ion cluster group in a mass range of about 4 Da is isolated in the quadrupole mass selector, subsequently accumulated in the collision cell for typically several hundreds of milliseconds, and finally transferred through the hexapole ion guide into the ICR cell. Ions captured in the ICR cell are excited by a dipolar broadband excitation chirp (frequency sweep from 150 to 3500 Da) applied for about 16 ms, with each single frequency step applied for 15 μs. The detection is performed in the heterodyne mode using a detection time duration of 7 s resulting in a moderately high resolving power so that at least the two most abundant isotope peaks in each of the first four non-monoistopic clusters could be resolved. Typically 50 scans are accumulated.

The ion population in the ICR cell is kept high enough to determine the fourth isotopic cluster with a reasonable intensity but low enough to avoid peak coalescence and minimize ion-ion interaction effects in the abundant peak clusters. In order to distinguish low-intensity isotope peaks from mathematical FFT sidebands of adjacent high-intensity peaks, a sine square window function is applied for the apodization of the transient. However, this reduces the initial resolving power by almost 40%. The time domain signal is then transformed using the FFT magnitude calculation, including a zero filling to four times the initial time domain size. These narrow band spectra acquired by mass selecting and isolating the ions of (practically) the complete isotopic pattern is called the "complete pattern spectra".

In the second step, each of the first four $^{13}C$ isotope cluster groups is measured separately. For this, one individual isotope cluster (e.g., the cluster group containing one $^{13}C$ isotope) is isolated in the quadrupole mass selector. After accumulation in the collision cell for typically several hundreds of milliseconds it is transferred into the ICR cell. In order to be able to measure all cluster groups (of different abundances) with roughly equal peak intensities, the ion population in the ICR cell is controlled by adjusting the ion transfer parameters of the electrospray source and the accumulation time in the collision cell. This allows using the same sample concentration for all experiments. The ion population in the ICR cell is kept low enough to avoid peak coalescence and ion-ion interactions. The detection is again performed in heterodyne mode, now choosing a detection time duration of about 45 s. Here also typically fifty scans are accumulated. This procedure turns out to be a good compromise between ideally high resolving power (e.g. 3,900,000) and good long-term resonance frequency stability during the overall detection time of about 40 min. The time domain signal again is transformed into a mass spectrum as described above. These spectra acquired by isolating individual $^{13}C$ isotope cluster groups and measuring them separately is called the "isolated isotope spectra".

Table 1a (FIG. 6*a*) shows mass and peak intensity values of the measured and simulated isotopic fine structure spectra of reserpine and substance P with resolving powers of 1,310,000 and 1,390,000, respectively. These values refer to the spectra where the monoisotopic peak and the first four $^{13}C$ isotope clusters were isolated and measured (complete pattern spectra).

Table 1b (FIGS. 6*b* and 6*c*) shows mass and peak intensity values of the measured and simulated isotopic fine structure spectra of reserpine and substance P. The data is obtained from individually isolated $^{13}C$ isotopic clusters (isolated isotope spectra). The relative peak intensities are normalized to the most abundant peak in each $^{13}C$ cluster (which is the pure $^{13}C$ peak in the first three $^{13}C$ isotopic clusters).

Table 2 (FIG. 7) shows the peaks from the isotopic pattern of compound $C_ZA_XB_Y$ consisting of elements A, B, and C. The element A has a primary isotope $^{M(A)}A$, a secondary isotope $^{M(A)+1}A$. The element B has a primary isotope $^{M(B)}B$ and a secondary isotope $^{M(B)+2}B$, and the third element C is in this case carbon. It has primary isotope $^{M(C)}C$, a secondary isotope $^{M(C)+1}C$. In the column labeled "Peak Intensity," letters denote substituted atoms. MP is the monoisotopic peak. The index of each element (A, B or C) denotes the number of the secondary isotope in the isotope cluster. In expressions for intensity, X, Y, and Z are coefficients of elements A, B, C. $p_2(A)$, $p_2(B)$, and $p_2(C)$ represent the occurrence probability of secondary isotope of the corresponding elements, $p_1(A)$, $p_1(B)$, and $p_1(C)$ are the occurrence probabilities of the primary isotope of each element (the isotope corresponding to the monoisotopic peak MP), and M is the mass of the monoisotopic peak.

Table 3 shows estimated number of atoms calculated by coefficient estimation. "I" represents the peak intensity. $I(A_1)$, $I(A_2)$, $I(B_1)$, $I(C_1)$, $I(C_2)$, $I(C_1A_1)$, etc. denote the peak intensities of the corresponding ions with indexed number of secondary isotope of those elements.

The number of each element in this example of the compound with the formula $C_ZA_XB_Y$ is estimated as follows. According to Table 2, to calculate the number Z of the C atoms, and without using the information from the monoisotopic peak we need the relative intensity information from the first and the second non-monoisotopic peak clusters. These are $I(A_1)/I(C_1)$ and $I(A_1C_1)/I(C_2)$. This way, we can calculate the two unknowns Z and X based on two equations. In order to be able to calculate the number Y of the B atoms, we need at least the first non-monoisotopic peak cluster in which the second isotope of B (the non-primary isotope) appears. This is, by definition, the second non-monoisotopic peak cluster, since the element B has as primary isotope $^{M(B)}B$ and as secondary isotope $^{M(B)+2}B$. Based on the relative intensity information $I(B_1)/I(C_2)$ and using the number Z of the C atoms which is already calculated, the number Y of the B atoms can be found.

Although for the calculations in the theoretical example above only two non-monoisotopic peak clusters were necessary, measuring more than two is better for confirmation/verification and good for the case that the peak intensities are not as accurate as the theory requires. Therefore, the data from all available peaks can be used for the elemental composition calculations, as far as the signal-to-noise ratio allows this (that is, peaks are identifiable above the detection threshold).

In the foregoing specification, specific exemplary embodiments of the invention have been described. It will, however, be evident that various modifications and changes may be made thereto. The specification and drawings are, accordingly, to be regarded in an illustrative rather than restrictive manner. Other embodiments will readily suggest themselves to a person skilled in the art having the benefit of this disclosure.

What is claimed is:

1. A method for the determination of an unknown elemental composition of a sample substance measured by ultrahigh resolution Fourier Transform (FT) mass spectrometry, comprising:

a. acquiring a mass spectrum of the sample substance with a full isotopic pattern using an FT analyzer cell;

b. isolating a non-monoisotopic peak cluster in the vicinity of a monoisotopic peak, wherein the isolation includes allowing only one selected non-monoisotopic peak cluster, comprising a plurality of unfragmented peaks, to be in the analyzer cell;

c. acquiring a narrowband mass spectrum of the isolated non-monoisotopic peak cluster, which allows resolution of an isotopic fine structure of the isolated non-monoisotopic peak cluster;

d. determining relative abundances and mass values of mass peaks corresponding to individual isotopes and isotope combinations of elements in the non-monoisotopic peak cluster;

e. isolating another non-monoisotopic peak cluster and repeating the procedures described in steps (c) and (d), and continuing until a predetermined minimum abundance of the non-monoisotopic peak clusters is reached; and f. determining the elemental composition by calculation from the isotopic fine structures using the relative abundances of the individually acquired non-monoisotopic peak clusters, wherein the mass values and the relative abundances of one non-monoisotopic peak cluster are cross-correlated to those of at least one other non-monoisotopic peak cluster.

2. The method according to claim 1, wherein the predetermined minimum abundance is defined by a signal-to-noise ratio.

3. The method according to claim 1, wherein the substance is an organic compound.

4. The method according to claim 3, wherein the organic compound is one of a peptide, polypeptide, and protein.

5. The method according to claim 1, wherein a resolving power for the acquisition of the narrowband mass spectrum in step (c) exceeds that for the acquisition of the mass spectrum with full isotopic pattern in step (a) by at least a factor of two.

6. The method according to claim 1, wherein the narrowband mass spectrum has a spectral width of less than or equal to approximately 1 Dalton.

7. The method according to claim 1, wherein a number of ions from which the narrowband mass spectrum is acquired in step (c) is lower than that from which the full isotopic pattern spectrum is acquired in step (a) in order to reduce detrimental effects of at least one of space charge and ion-ion interaction on the resolving power.

8. The method according to claim 1, wherein one of an FT-ICR mass spectrometer and FT-Orbitrap mass spectrometer is used as ultrahigh resolving power mass analyzer for acquiring the ultrahigh resolution mass spectrum.

9. The method according to claim 8, wherein the isolation of an individual non-monoisotopic peak cluster is performed in the ultrahigh resolving power mass analyzer.

10. The method according to claim 1, wherein isolating an individual non-monoisotopic peak cluster comprises using a mass filter to selectively transmit ions of the non-monoisotopic peak cluster to an ultrahigh resolving power mass analyzer used for acquiring the ultrahigh resolution mass spectrum.

11. The method according to claim 10, wherein the mass filter is one of a linear multipole mass analyzer, 3D ion trap mass analyzer and ICR mass analyzer cell.

12. The method according to claim 11, wherein the ICR mass analyzer cell to be used as a mass filter is placed in a same magnet as the ICR mass analyzer cell which is used to acquire the ultrahigh resolution mass spectrum.

13. The method according to claim 11, wherein the ICR mass analyzer cell to be used as a mass filter is placed in a separate magnet.

14. The method according to claim 11, wherein the linear multipole mass analyzer is a quadrupole rod set mass analyzer.

15. The method according to claim 1, wherein the elemental composition comprises information about the abundance of at least one of $^{13}C$, $^{15}N$, $^{17}O$, $^{18}O$, $^{2}H$, $^{33}S$, $^{34}S$.

* * * * *